US010535286B2

(12) United States Patent
Gupta et al.

(10) Patent No.: US 10,535,286 B2
(45) **Date of Patent: *Jan. 14, 2020**

(54) SENSING FOR COMPENSATION OF PIXEL VOLTAGES

(71) Applicant: Apple Inc., Cupertino, CA (US)

(72) Inventors: Vasudha Gupta, Cupertino, CA (US); Chin-Wei Lin, San Jose, CA (US); Tsung-Ting Tsai, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/255,562

(22) Filed: Jan. 23, 2019

(65) Prior Publication Data

US 2019/0156719 A1 May 23, 2019

Related U.S. Application Data

(63) Continuation of application No. 15/874,687, filed on Jan. 18, 2018, now Pat. No. 10,217,390, which is a continuation-in-part of application No. 15/271,115, filed on Sep. 20, 2016, now Pat. No. 10,186,200.

(51) Int. Cl.

| | |
|---|---|
| ***G09G 3/00*** | (2006.01) |
| ***G09G 3/3266*** | (2016.01) |
| ***G09G 3/3233*** | (2016.01) |

(52) U.S. Cl.

CPC ..... *G09G 3/006* (2013.01); *G09G 3/3233* (2013.01); *G09G 3/3266* (2013.01); *G09G 2300/0819* (2013.01); *G09G 2300/0842* (2013.01); *G09G 2300/0861* (2013.01); *G09G 2310/0216* (2013.01); *G09G 2320/0233* (2013.01); *G09G 2320/0242* (2013.01); *G09G 2320/0295* (2013.01); *G09G 2320/045* (2013.01); *G09G 2330/12* (2013.01)

(58) Field of Classification Search

CPC .... G09G 3/006; G09G 3/3233; G09G 3/3266; G09G 2300/0819; G09G 2300/0842; G09G 2300/0861; G09G 2310/0216; G09G 2320/0233; G09G 2320/0242; G09G 2320/0295; G09G 2320/045; G09G 2330/12

See application file for complete search history.

(56) References Cited

U.S. PATENT DOCUMENTS

| | | | |
|---|---|---|---|
| 7,652,645 | B2 | 1/2010 | Park et al. |
| 8,508,525 | B2 | 8/2013 | Komiya et al. |
| 9,349,316 | B2 | 5/2016 | Kim et al. |
| 9,495,928 | B2 | 11/2016 | Jiang et al. |

(Continued)

*Primary Examiner* — Peter D McLoone
(74) *Attorney, Agent, or Firm* — Fletcher Yoder, P.C.

(57) ABSTRACT

A display device may include rows of pixels that may display image data on a display and a circuit. The circuit may perform a progressive scan across the rows of pixels to display the image data using a plurality of pixels, supply test data to a pixel of plurality of pixels that corresponds to a first row of the rows of pixels during one frame of the progressive scan, and initiate a sensing period for determining one or more sensitivity properties associated with the pixel based on the performance of the pixel with respect to the test data in response to receiving a pulse of a first global signal. The circuit may then end the sensing period in response to receiving a second global signal and resume the progressive scan across the rows of pixels to display the image data after the sensing period ends.

20 Claims, 21 Drawing Sheets

(56) References Cited

U.S. PATENT DOCUMENTS

| | | | |
|---|---|---|---|
| 9,552,091 | B2 | 1/2017 | Fan et al. |
| 9,734,754 | B2 | 8/2017 | Ohara et al. |
| 9,734,765 | B2 | 8/2017 | Kwon et al. |
| 9,875,685 | B2 | 1/2018 | Kwon et al. |
| 9,886,894 | B2 | 2/2018 | Ohara et al. |
| 2006/0022912 | A1 | 2/2006 | Park et al. |
| 2011/0279436 | A1 | 11/2011 | Komiya et al. |
| 2013/0147690 | A1 | 6/2013 | Kim et al. |
| 2014/0253603 | A1 | 9/2014 | Kwon et al. |
| 2015/0138177 | A1 | 5/2015 | Kwon et al. |
| 2015/0310820 | A1 | 10/2015 | Jiang et al. |
| 2016/0125796 | A1 | 5/2016 | Ohara et al. |
| 2016/0179258 | A1 | 6/2016 | Fan et al. |
| 2017/0186373 | A1 | 6/2017 | Nishikawa et al. |
| 2017/0316735 | A1 | 11/2017 | Ohara et al. |
| 2018/0075798 | A1 | 3/2018 | Nho et al. |

SENSING FOR COMPENSATION OF PIXEL VOLTAGES

CROSS REFERENCE TO RELATED APPLICATION

This application is a continuation of and claims priority to U.S. patent application Ser. No. 15/874,687, filed Jan. 18, 2018, and entitled "SENSING FOR COMPENSATION OF PIXEL VOLTAGES," which is a continuation-in-part of U.S. patent application Ser. No. 15/271,115, filed Sep. 20, 2016, and entitled "SENSING FOR COMPENSATION OF PIXEL VOLTAGES," the disclosure of which is incorporated herein by reference in its entirety and for all purposes.

BACKGROUND

The present disclosure relates to systems and methods for sensing characteristics of pixels in electronic display devices to compensate for non-uniformity in luminance or color of a pixel with respect to other pixels in the electronic display device.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

As electronic displays are employed in a variety of electronic devices, such as mobile phones, televisions, tablet computing devices, and the like, manufacturers of the electronic displays continuously seek ways to improve the consistency of colors depicted on the electronic display devices. For example, given variations in manufacturing, various noise sources present within a display device, or various ambient conditions in which each display device operates, different pixels within a display device might emit a different color value or gray level even when provided with the same electrical input. It is desirable, however, for the pixels to uniformly depict the same color or gray level when the pixels programmed to do so to avoid visual display artifacts due to inconsistent color.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain electronic display devices, light-emitting diodes such as organic light-emitting diodes (OLEDs), micro-LEDs (μLEDs), or active matrix organic light-emitting diodes (AMOLEDs) may be employed as pixels to depict a range of gray levels for display. However, due to various properties associated with the operation of these pixels within the display device, a particular gray level output by one pixel in a display device may be different from a gray level output by another pixel in the same display device upon receiving the same electrical input. As such, the electrical inputs may be calibrated to account for these differences by sensing the electrical values that get stored into the pixels and adjusting the input electrical values accordingly. Since a more accurate and/or precise determination of the sensed electrical value in the pixel may be used to obtain a more consistent and/or exact calibration, the present disclosure details various systems and methods that may be employed to implement a sensing scheme to sense variations in pixel properties (e.g., current, voltage) and modify a data voltage applied to a respective pixel based on the sensed variation. The corrected data voltage, when applied to the respective pixel, may compensate for the variations in the pixel properties to achieve a more uniform image that will be depicted on the display device.

In one embodiment, a sensing system of a display device may sense a pixel voltage applied to a respective pixel during a panel scan for data program. That is, the sensing system may transmit pixel data to each row of pixels during a panel scan. During the panel scan for one row of pixels, the sensing system may interrupt the panel scan for a portion of the panel scan to send a first data voltage (e.g., known test voltage) to drive a thin film transistor (TFT) of a respective pixel. After the first data voltage is transmitted to the TFT, the sensing system may determine the sensitivity properties of the respective pixel based on the detected power output by the respective pixel. The sensitivity properties may include current or voltage properties related to the respective pixel that vary as a function of certain pixel properties. The variation in the current or voltage properties may be sensed, amplified, digitized, and applied as a correction factors of the pixel data voltage to compensate for the pixel property variations. After determining the sensitivity properties for the respective pixel, the sensing system may then resume the panel scan for the remaining portion of the one row of pixels. As such, the sensing system may transmit data voltages to the remaining pixels of the display device.

In certain embodiments, the sensing system may perform the sensing scheme described above a number of times and may provide the results of the sensing scheme to another component that may determine a compensation voltage for each respective pixel. That is, based on the results of the sensing scheme, a processor (or other like device) may determine an amount of disparity exists between the first data voltage used to drive the respective pixel during a sensing period and the resulting power emitted by the respective pixel. Based on the detected discrepancies over each sensing period, the processor may determine a compensation voltage to apply to the respective pixel to cause the respective pixel to emit a desired (e.g., uniform) color and/or luminance with respect to the other pixels of the display device.

To interrupt the panel scan to perform the sensing scheme described above, the sensing system may employ a pixel driving circuit for each respective pixel that uses a data input, two scan line inputs (Scan1, Scan2), and two emission turn-on inputs (EM1, EM2) to implement a pixel driving scheme that uses a portion of a panel scan of a row of pixels to send a data signal (e.g., voltage) used to determine the sensitivity properties of a respective pixel and then transmit the appropriate data signal, as per the desired image data to be depicted, to the respective pixel. In one embodiment, the sensing system may coordinate the two scan line inputs (Scan1, Scan2) and the two emission turn-on inputs (EM1, EM2) to cause the pixel driving circuit to suspend the data transmission to a respective pixel for a period of time when the sensing operation is performed. After the sensing operation is performed, the pixel driving circuit may trigger the data transmission to resume for the remaining pixels of the respective row of pixels. By suspending the data programming of a respective pixel and performing a real-time sensing operations for the respective pixel during the panel scan, the sensing system determines the sensitivity properties of each pixel in the display device while the display device is displaying image data. In this way, the sensing system may provide data to other components that may be used to determine compensation values (e.g., voltage) to provide each respective pixel based on the properties of the respective pixel during operation (e.g., display of image data). As such, the compensated values account for a variety of sources for pixel color and luminance variations among the pixels of the display. Moreover, the display driver may adjust the original pixel data provides to the pixels based on the compensated values while the display device is in operation to compensate for the determined sensitivity properties.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
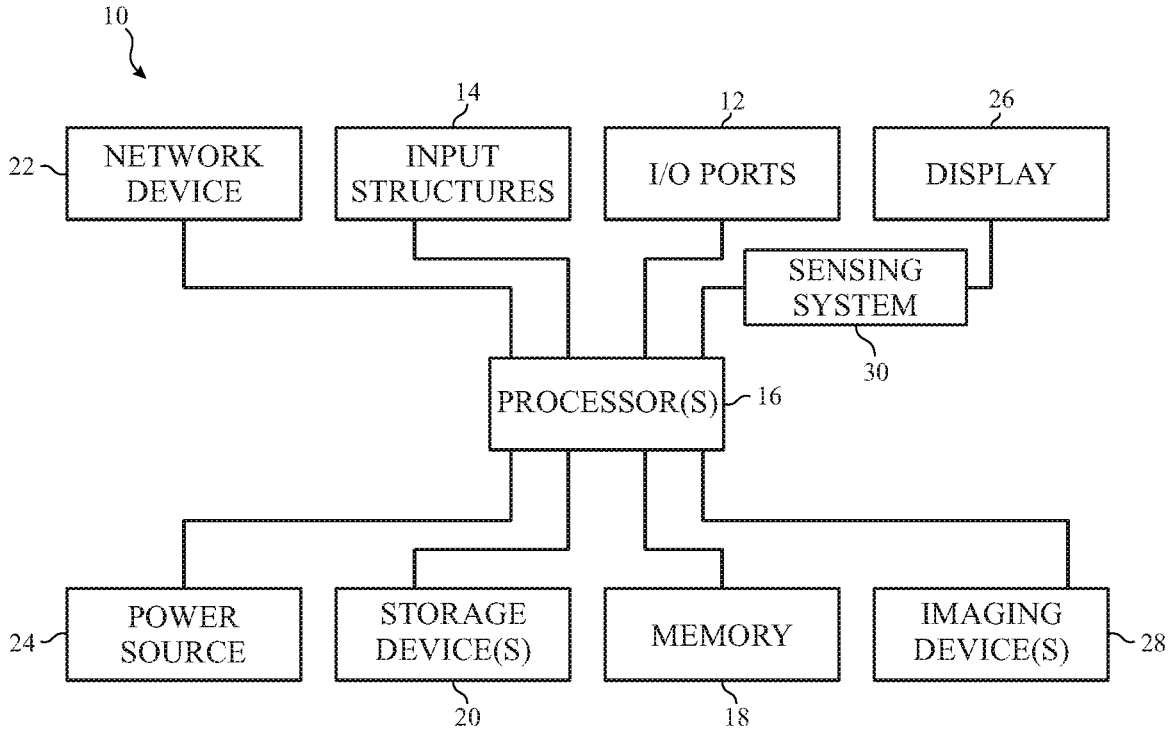
FIG. 1 is a simplified block diagram of components of an electronic device that may depict image data on a display, in accordance with embodiments described herein.

One or more specific embodiments of the present disclosure will be described below. These described embodiments are only examples of the presently disclosed techniques.

Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but may nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Organic light-emitting diode (e.g., OLED, AMOLED) display panels provide opportunities to make thin, flexible, high-contrast, and color-rich electronic displays. Generally, OLED display devices are current driven devices and use thin film transistors (TFTs) as current sources to provide certain amount of current to generate a certain level of luminance to a respective pixel electrode. OLED Luminance to current ratio is generally represented as OLED efficiency with units: cd/A (Luminance/Current Density or $(cd/m^2)/(A/m^2)$). Each respective TFT, which provides current to a respective pixel, may be controlled by gate to source voltage ($V_{gs}$), which is stored on a capacitor ($C_{st}$) electrically coupled to the LED of the pixel.

Generally, the application of the gate-to-source voltage $V_{gs}$ on the capacitor $C_{st}$ is performed by programming voltage on a corresponding data line to be provided to a respective pixel. However, when providing the voltage on a data line, several sources of noise or variation in the OLED-TFT system can result in either localized (e.g., in-panel) or global (e.g., panel to panel) non-uniformity in luminance or color. Variations in the TFT system may be addressed in a number of ways. For instance, an in-pixel compensation scheme may involve in-pixel sensing of a threshold voltage for a respective TFT before applying an intended data voltage to the respective pixel. However, in-pixel sensing could involve multiple stages (e.g., initialization, sensing, and data application) for pixels in every row that correspond to relatively long row times (e.g., tens of microseconds). With this in mind, displays with large number of rows that are driven at 120 Hz, as opposed to 60 Hz, provide relatively small row times (e.g., 3-4 μs) for programming. As such, in-pixel compensation may not provide a feasible way to compensate voltages provided on a data line to the respective pixel.

In one embodiment, the data values provided to the pixels may be compensated using a compensation system. For example, a display driver may employ a sensing system to implement voltage or current sensing schemes to sense operational variations among pixels, then digitize and transmit this information to processor(s) external to the display that adjust the image data before it is provided to the display. In particular, the processor(s) may modify the image data based on the sensed variation and transmit the modified data voltage to the respective pixel. The modified data voltage, when applied to the pixels, helps realize a uniform image.

To effectively perform the external compensation scheme generally described above, variations in pixel properties may be sensed at various times by the display driver when the display is off, during a blanking time, or during a progressive scan of the display device. The main point for external compensation is that only data is programmed into the pixel during regular row time. As such, the display driver may sense variations in various properties (e.g., color, luminance) of a pixel using relatively short row times, as compared to using in-pixel sensing schemes.

For fast sensing schemes (e.g., real time or near-real time), the display driver (e.g., sensing system) may embed a certain amount of time to sense variations in certain properties of a pixel in one row during the regular panel scan for data program of the respective pixel. In order to embed this sensing time into the progressive panel scan, the display driver may employ different circuits to generate emission signals and scan signals in a particular manner to trigger a sensing period during the progressive scan and trigger the resumption of the progressive scan after the sensing period. In one embodiment, the display driver may employ a pixel driving circuit for each respective pixel that uses four inputs (two scan inputs and two emission signal inputs) to pause the transmission of data to the respective pixel, sense the properties of the pixel, and resume the transmission of data to the respective during a progressive scan of the display. As a result, the display driver may acquire information related to the properties of the respective pixel. The display driver may then send the acquired information to a processor that may determine a compensation value for data signals provided to the respective pixel based on the information and provide corrected data signals to the display driver, which may provide the corrected data signals to the respective pixels. Additional details with regard to the systems and techniques involved with enabling the display driver to perform fast (e.g., real-time or near real-time) sensing of pixel sensitivity properties during a progressive scan is detailed below with reference to FIGS. 1-22.

By way of introduction, FIG. 1 is a block diagram illustrating an example of an electronic device 10 that may include the sensing system mentioned above. The electronic device 10 may be any suitable electronic device, such as a laptop or desktop computer, a mobile phone, a digital media player, television, or the like. By way of example, the electronic device 10 may be a portable electronic device, such as a model of an iPod® or iPhone®, available from Apple Inc. of Cupertino, Calif. The electronic device 10 may be a desktop or notebook computer, such as a model of a MacBook®, MacBook® Pro, MacBook Air®, iMac®, Mac® Mini, or Mac Pro®, available from Apple Inc. In other embodiments, electronic device 10 may be a model of an electronic device from another manufacturer.

As shown in FIG. 1, the electronic device 10 may include various components. The functional blocks shown in FIG. 1 may represent hardware elements (including circuitry), software elements (including code stored on a computer-readable medium) or a combination of both hardware and software elements. In the example of FIG. 1, the electronic device 10 includes input/output (I/O) ports 12, input structures 14, one or more processors 16, a memory 18, non-volatile storage 20, networking device 22, power source 24, display 26, and one or more imaging devices 28. It should be appreciated, however, that the components illustrated in FIG. 1 are provided only as an example. Other embodiments of the electronic device 10 may include more or fewer components. To provide one example, some embodiments of the electronic device 10 may not include the imaging device(s) 28.

Before continuing further, it should be noted that the system block diagram of the device 10 shown in FIG. 1 is intended to be a high-level control diagram depicting various components that may be included in such a device 10. That is, the connection lines between each individual component shown in FIG. 1 may not necessarily represent paths or directions through which data flows or is transmitted between various components of the device 10. Indeed, as discussed below, the depicted processor(s) 16 may, in some embodiments, include multiple processors, such as a main processor (e.g., CPU), and dedicated image and/or video processors. In such embodiments, the processing of image data may be primarily handled by these dedicated processors, thus effectively offloading such tasks from a main processor (CPU).

Considering each of the components of FIG. 1, the I/O ports 12 may represent ports to connect to a variety of devices, such as a power source, an audio output device, or other electronic devices. The input structures 14 may enable user input to the electronic device, and may include hardware keys, a touch-sensitive element of the display 26, and/or a microphone.

The processor(s) 16 may control the general operation of the device 10. For instance, the processor(s) 16 may execute an operating system, programs, user and application interfaces, and other functions of the electronic device 10. The processor(s) 16 may include one or more microprocessors and/or application-specific microprocessors (ASICs), or a combination of such processing components. For example, the processor(s) 16 may include one or more instruction set (e.g., RISC) processors, as well as graphics processors (GPU), video processors, audio processors and/or related chip sets. As may be appreciated, the processor(s) 16 may be coupled to one or more data buses for transferring data and instructions between various components of the device 10. In certain embodiments, the processor(s) 16 may provide the processing capability to execute an imaging applications on the electronic device 10, such as Photo Booth®, Aperture®, iPhoto®, Preview®, iMovie®, or Final Cut Pro® available from Apple Inc., or the "Camera" and/or "Photo" applications provided by Apple Inc. and available on some models of the iPhone®, iPod®, and iPad®.

A computer-readable medium, such as the memory 18 or the nonvolatile storage 20, may store the instructions or data to be processed by the processor(s) 16. The memory 18 may include any suitable memory device, such as random access memory (RAM) or read only memory (ROM). The nonvolatile storage 20 may include flash memory, a hard drive, or any other optical, magnetic, and/or solid-state storage media. The memory 18 and/or the nonvolatile storage 20 may store firmware, data files, image data, software programs and applications, and so forth.

The network device 22 may be a network controller or a network interface card (NIC), and may enable network communication over a local area network (LAN) (e.g., Wi-Fi), a personal area network (e.g., Bluetooth), and/or a wide area network (WAN) (e.g., a 3G or 4G data network). The power source 24 of the device 10 may include a Li-ion battery and/or a power supply unit (PSU) to draw power from an electrical outlet or an alternating-current (AC) power supply.

The display 26 may display various images generated by device 10, such as a GUI for an operating system or image data (including still images and video data). The display 26 may be any suitable type of display, such as a liquid crystal display (LCD), plasma display, or an organic light emitting diode (OLED) display, for example. In one embodiment, the display 26 may include self-emissive pixels such as organic light emitting diodes (OLEDs) or micro-light-emitting-diodes (μ-LEDs).

Additionally, as mentioned above, the display 26 may include a touch-sensitive element that may represent an input structure 14 of the electronic device 10. The imaging device(s) 28 of the electronic device 10 may represent a digital camera that may acquire both still images and video. Each imaging device 28 may include a lens and an image sensor capture and convert light into electrical signals.

In certain embodiments, the electronic device 10 may include a sensing system 30, which may include a chip, such as processor or ASIC, that may control various aspects of the display 26. For instance, the sensing system 30 may use a voltage signal that is to be provided to a pixel of the display 26 to sense the gray level depicted by the pixel. Generally, when the same voltage signal is provided to each pixel of the display 26, each pixel should depict the same gray level. However, due to various sources of noise, the same voltage being applied to a number of pixels may result in a variety of different gray levels depicted across the number of pixels. As such, the sensing system 30 may sense a threshold voltage of each pixel, a power output by each pixel, an amount of current provided to each pixel and the sensing system 30 may send the threshold voltage to the processor(s) 16 or other circuit component to determine a compensation value for each pixel. The processor(s) 16 may then adjust the data signals provided to each pixel based on the compensation value. Although the sensing system 30 is described as providing the threshold voltage or sensitivity characteristics to another circuit component that may determine a compensation value, it should be noted that, in some embodiments, the sensing system 30 may also perform the determination of the compensation value and the modification of the data provided to a pixel based on the compensation value.

Figure 2:
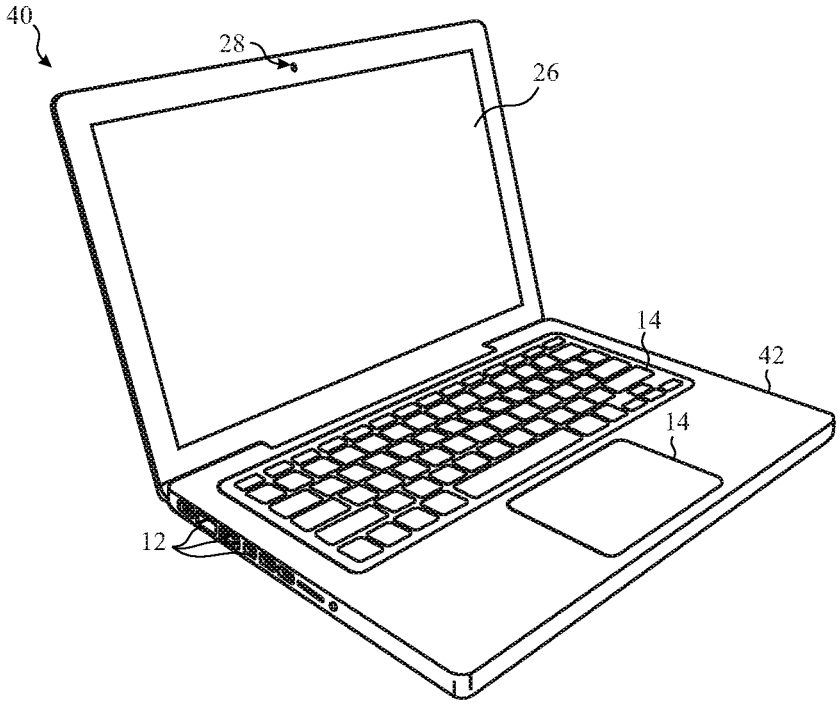
FIG. 2 is a perspective view of the electronic device of FIG. 1 in the form of a notebook computing device, in accordance with embodiments described herein.

As mentioned above, the electronic device 10 may take any number of suitable forms. Some examples of these possible forms appear in FIGS. 2-5. Turning to FIG. 2, a notebook computer 40 may include a housing 42, the display 26, the I/O ports 12, and the input structures 14. The input structures 14 may include a keyboard and a touchpad mouse that are integrated with the housing 42. Additionally, the input structure 14 may include various other buttons and/or switches which may be used to interact with the computer 40, such as to power on or start the computer, to operate a GUI or an application running on the computer 40, as well as adjust various other aspects relating to operation of the computer 40 (e.g., sound volume, display brightness, etc.). The computer 40 may also include various I/O ports 12 that provide for connectivity to additional devices, as discussed above, such as a FireWire® or USB port, a high definition multimedia interface (HDMI) port, or any other type of port that is suitable for connecting to an external device. Additionally, the computer 40 may include network connectivity (e.g., network device 22), memory (e.g., memory 18), and storage capabilities (e.g., storage device 20), as described above with respect to FIG. 1.

The notebook computer 40 may include an integrated imaging device 28 (e.g., a camera). In other embodiments, the notebook computer 40 may use an external camera (e.g., an external USB camera or a "webcam") connected to one or more of the I/O ports 12 instead of or in addition to the integrated imaging device 28. In certain embodiments, the depicted notebook computer 40 may be a model of a MacBook®, MacBook® Pro, MacBook Air®, or PowerBook® available from Apple Inc. In other embodiments, the computer 40 may be portable tablet computing device, such as a model of an iPad® from Apple Inc.

Figure 3:
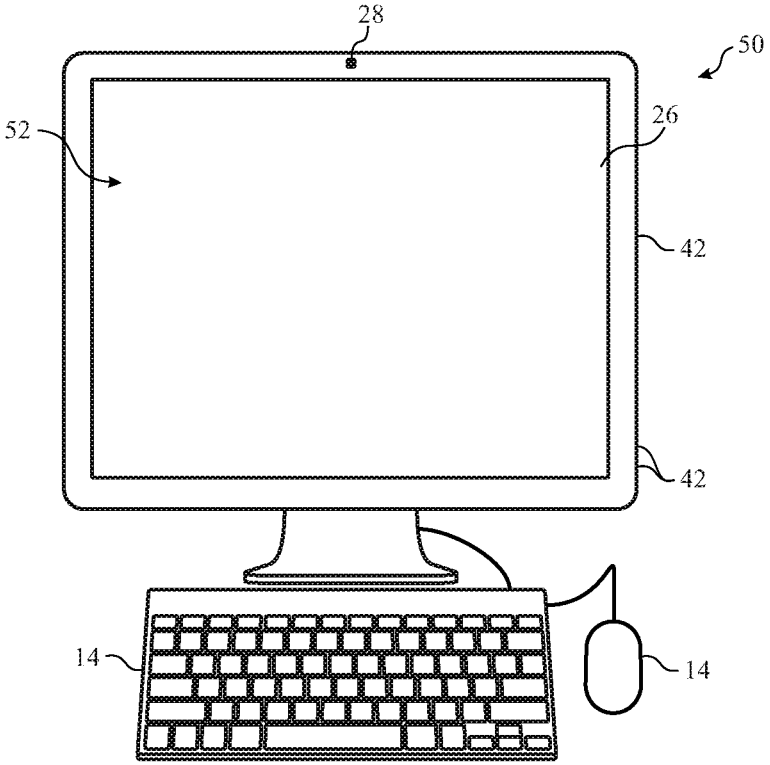
FIG. 3 is a front view of the electronic device of FIG. 1 in the form of a desktop computing device, in accordance with embodiments described herein.

FIG. 3 shows the electronic device 10 in the form of a desktop computer 50. The desktop computer 50 may include a number of features that may be generally similar to those provided by the notebook computer 40 shown in FIG. 4, but may have a generally larger overall form factor. As shown, the desktop computer 50 may be housed in an enclosure 42 that includes the display 26, as well as various other components discussed above with regard to the block diagram shown in FIG. 1. Further, the desktop computer 50 may include an external keyboard and mouse (input structures 14) that may be coupled to the computer 50 via one or more I/O ports 12 (e.g., USB) or may communicate with the computer 50 wirelessly (e.g., RF, Bluetooth, etc.). The desktop computer 50 also includes an imaging device 28, which may be an integrated or external camera, as discussed above. In certain embodiments, the depicted desktop computer 50 may be a model of an iMac®, Mac® mini, or Mac Pro®, available from Apple Inc.

Figure 4:
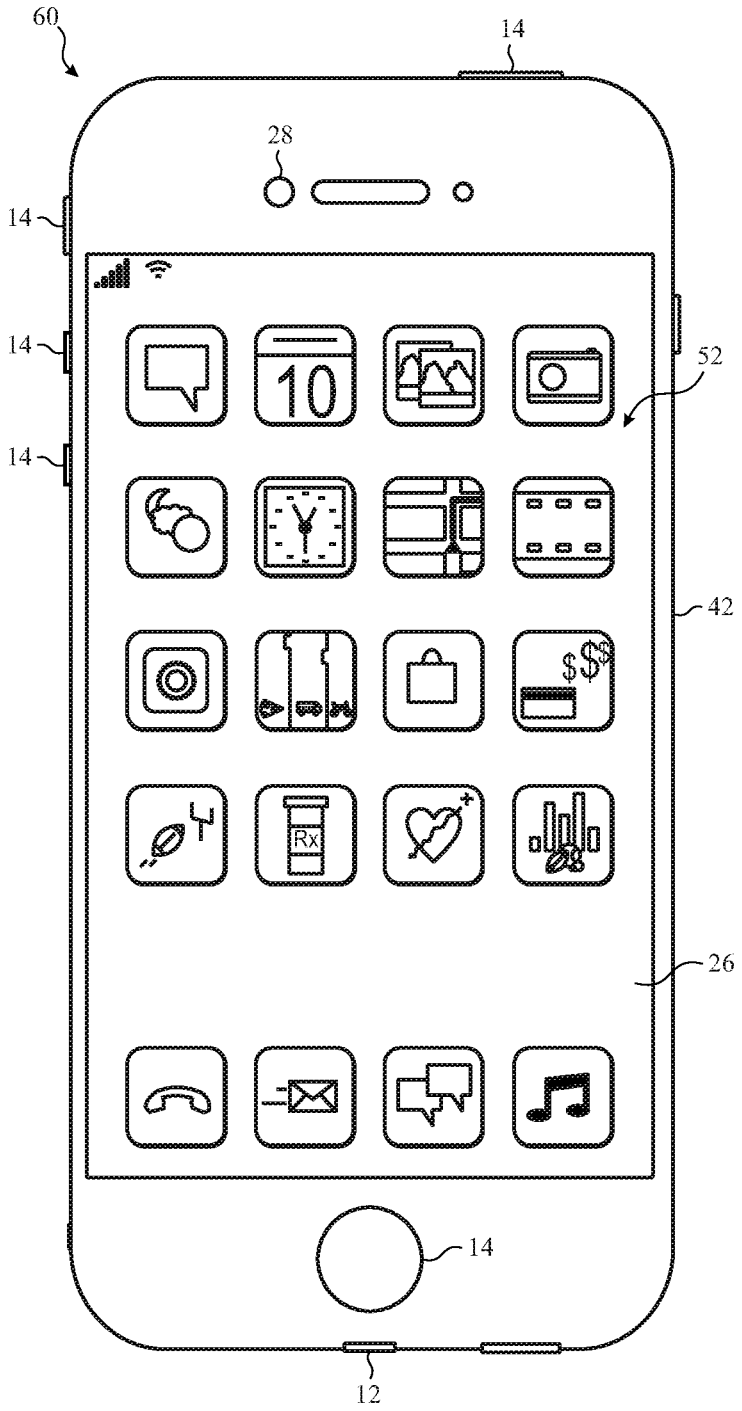
FIG. 4 is a front view of the electronic device of FIG. 1 in the form of a handheld portable electronic device, in accordance with embodiments described herein.
Figure 5:
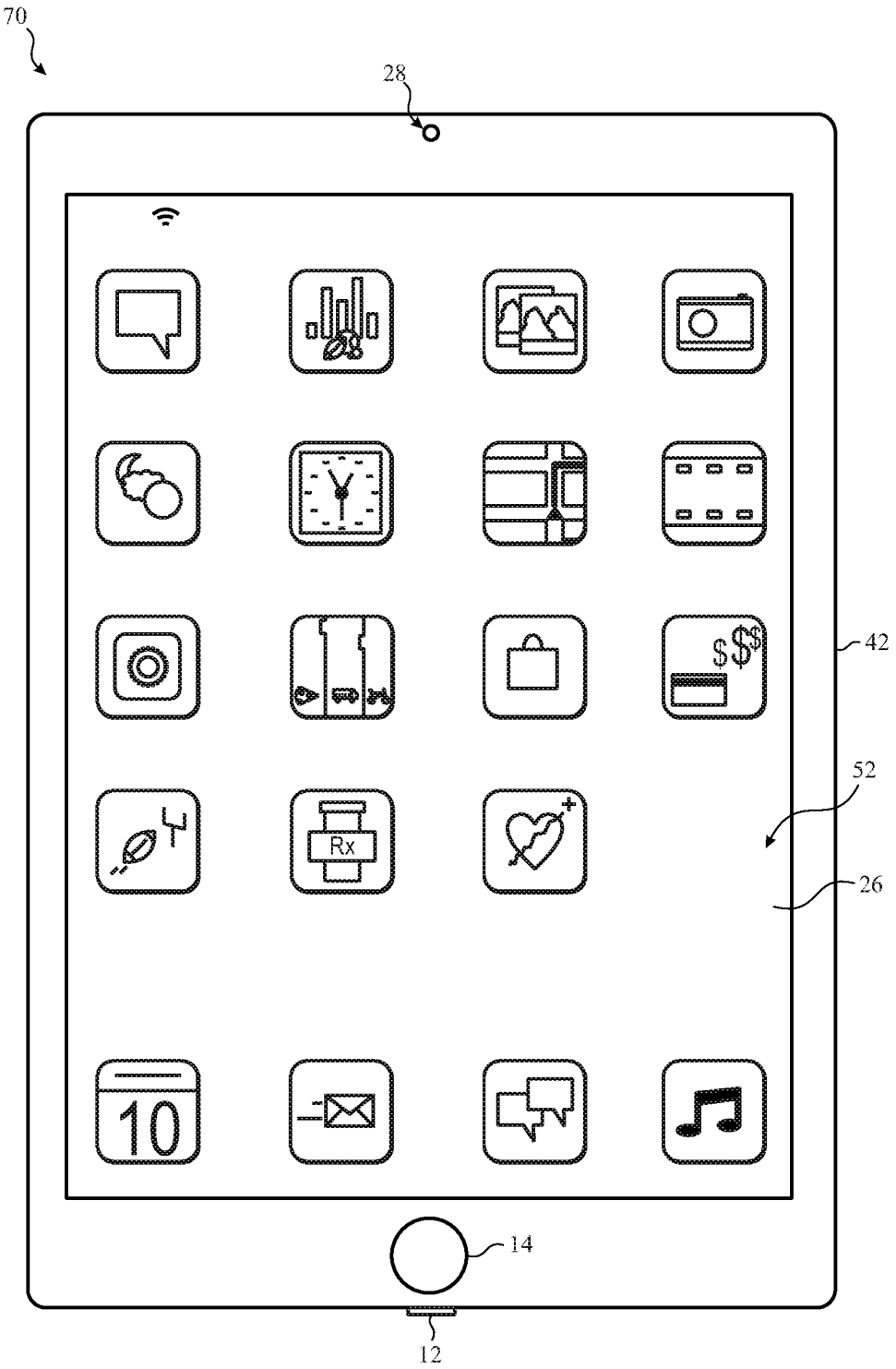
FIG. 5 is a front view of the electronic device of FIG. 1 in the form of a tablet computing device, in accordance with embodiments described herein.

The electronic device 10 may also take the form of portable handheld device 60 or 70, as shown in FIGS. 4 and 5. By way of example, the handheld device 60 or 70 may be a model of an iPod® or iPhone® available from Apple Inc. The handheld device 60 or 70 includes an enclosure 42, which may function to protect the interior components from physical damage and to shield them from electromagnetic interference. The enclosure 42 also includes various user input structures 14 through which a user may interface with the handheld device 60 or 70. Each input structure 14 may control various device functions when pressed or actuated. As shown in FIGS. 4 and 5, the handheld device 60 or 70 may also include various I/O ports 12. For instance, the depicted I/O ports 12 may include a proprietary connection port for transmitting and receiving data files or for charging a power source 24. Further, the I/O ports 12 may also be used to output voltage, current, and power to other connected devices.

The display 26 may display images generated by the handheld device 60 or 70. For example, the display 26 may display system indicators that may indicate device power status, signal strength, external device connections, and so forth. The display 26 may also display a GUI 52 that allows a user to interact with the device 60 or 70, as discussed above with reference to FIG. 3. The GUI 52 may include graphical elements, such as the icons, which may correspond to various applications that may be opened or executed upon detecting a user selection of a respective icon.

Figure 6:
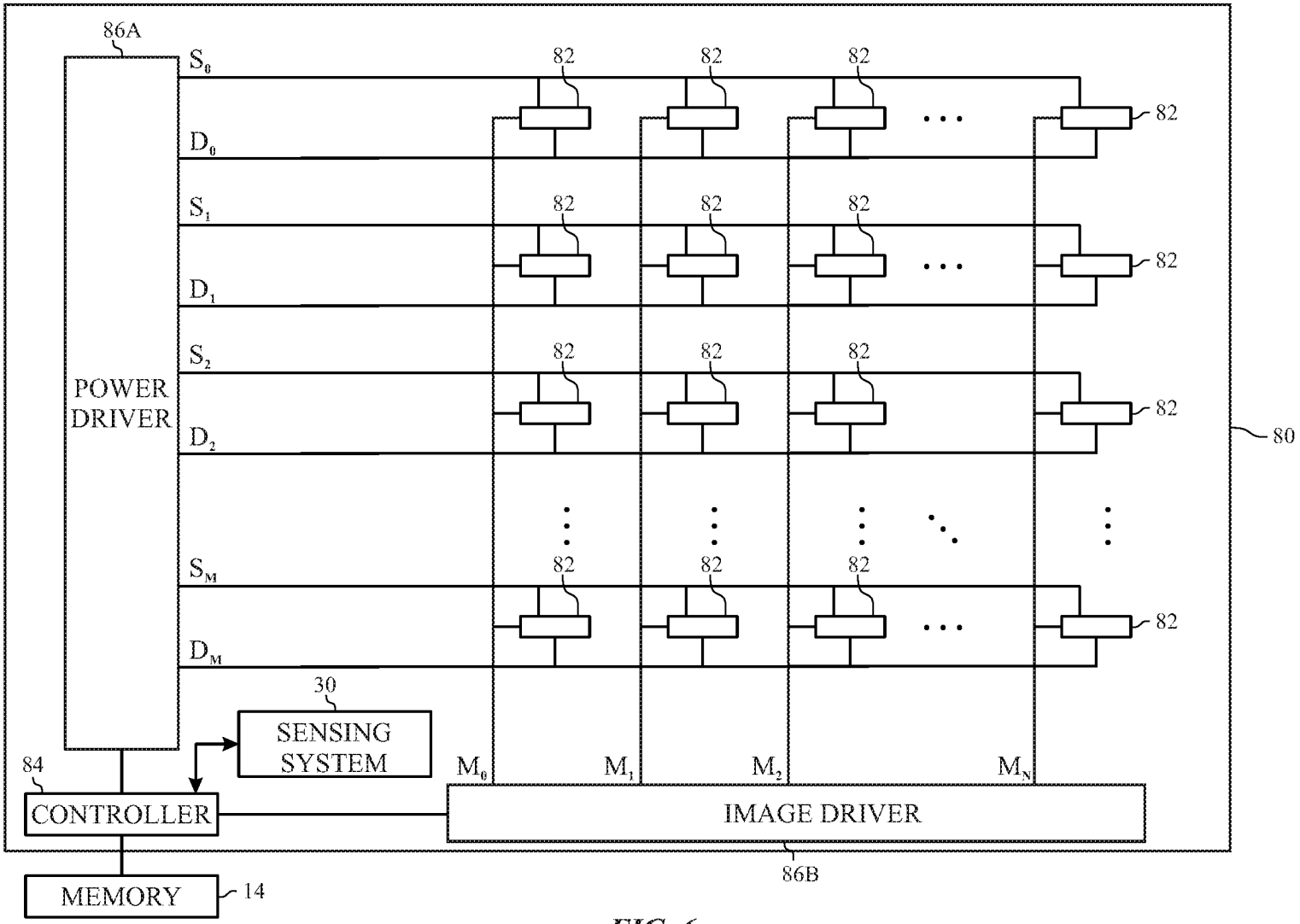
FIG. 6 is a circuit diagram of an array of self-emissive pixels of the electronic display of the electronic device of FIG. 1, in accordance with aspects of the present disclosure.

Having provided some context with regard to possible forms that the electronic device 10 may take, the present discussion will now focus on the sensing system 30 of FIG. 1. Generally, the brightness depicted by each respective pixel in the display 26 is generally controlled by varying an electric field associated with each respective pixel in the display 26. Keeping this in mind, FIG. 6 illustrates one embodiment of a circuit diagram of display 26 that may generate the electrical field that energizes each respective pixel and causes each respective pixel to emit light at an intensity corresponding to an applied voltage. As shown, display 26 may include a self-emissive pixel array 80 having an array of self-emissive pixels 82.

The self-emissive pixel array 80 is shown having a controller 84, a power driver 86A, an image driver 86B, and the array of self-emissive pixels 82. The self-emissive pixels 82 are driven by the power driver 86A and image driver 86B. Each power driver 86A and image driver 86B may drive one or more self-emissive pixels 82. In some embodiments, the power driver 86A and the image driver 86B may include multiple channels for independently driving multiple self-emissive pixels 82. The self-emissive pixels may include any suitable light-emitting elements, such as organic light emitting diodes (OLEDs), micro-light-emitting-diodes (μ-LEDs), and the like.

The power driver 86A may be connected to the self-emissive pixels 82 by way of scan lines $S_0$, $S_1$, . . . $S_{m-1}$, and $S_m$ and driving lines $D_0$, $D_1$, . . . $D_{m-1}$, and $D_m$. The self-emissive pixels 82 receive on/off instructions through the scan lines $S_0$, $S_1$, $S_{m-1}$, and $S_m$ and generate driving currents corresponding to data voltages transmitted from the driving lines $D_0$, $D_1$, . . . $D_{m-1}$, and $D_m$. The driving currents are applied to each self-emissive pixel 82 to emit light according to instructions from the image driver 86B through driving lines $M_0$, $M_1$, . . . $M_{n-1}$, and $M_n$. Both the power driver 86A and the image driver 86B transmit voltage signals through respective driving lines to operate each self-emissive pixel 82 at a state determined by the controller 84 to emit light. Each driver may supply voltage signals at a duty cycle and/or amplitude sufficient to operate each self-emissive pixel 82.

The controller 84 may control the color of the self-emissive pixels 82 using image data generated by the processor(s) 16 and stored into the memory 18 or provided directly from the processor(s) 16 to the controller 84. The sensing system 30 may provide a signal to the controller 84 to adjust the data signals transmitted to the self-emissive pixels 82 such that the self-emissive pixels 82 may depict substantially uniform color and luminance provided the same current input in accordance with the techniques that will be described in detail below.

Figure 7:
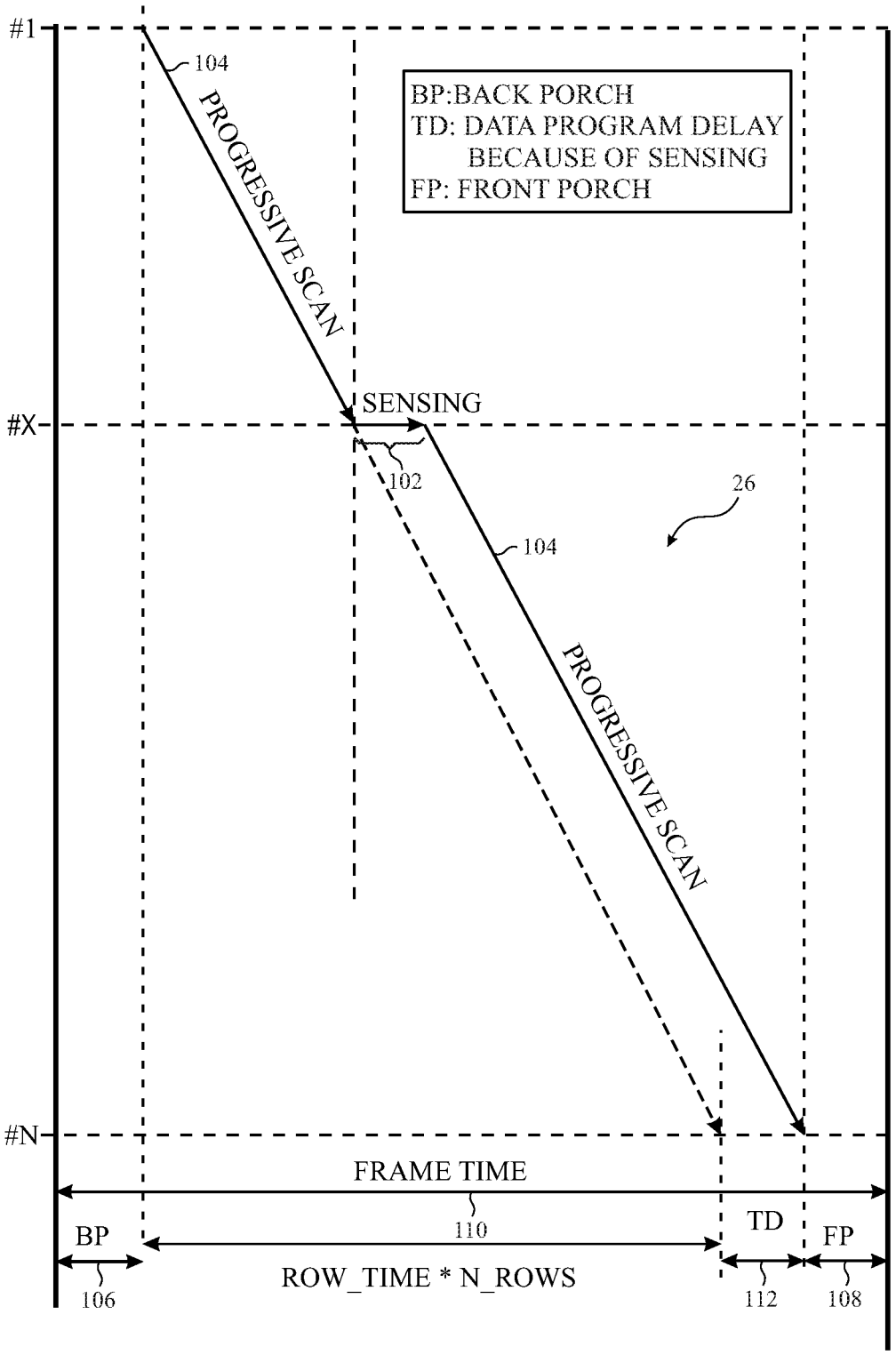
FIG. 7 is an example of a progressive scan that includes a sensing period implemented on a display of the electronic device of FIG. 1, in accordance with embodiments described herein.

With the foregoing in mind, FIG. 7 illustrates an embodiment in which the sensing system 30 may incorporate a sensing period during a progressive data scan of the display 26. In one embodiment, the controller 84 may send data (e.g., gray level voltages or currents) to each self-emissive pixel 82 via the power driver 86A on a row-by-row basis. That is, the controller 84 may initially cause the power driver 86A to send data signals to the pixels 82 of the first row of pixels on the display 26, then the second row of pixels on the display 26, and so forth. When incorporating a sensing period, the sensing system 30 may cause the controller 84 to pause the transmission of data via the power driver 86A for a period of time (e.g., 100 microseconds) during the progressive data scan at a particular row of the display (e.g., for row X). The period of time in which the power driver 86A stops transmitting data corresponds to a sensing period 102.

As shown in FIG. 7, the progressive scan 104 is performed between a back porch 106 and a front porch 108 of a frame 110 of data. The progressive scan 104 is interrupted by the sensing period 102 while the power driver 86A is transmitting data to row X of the display 26. The sensing period 102 corresponds to a period of time in which a data signal may be transmitted to a respective pixel 82, and the sensing system 30 may determine certain sensitivity properties associated to the respective pixel 82 based on the pixel's reaction to the data signal. The sensitivity properties may include, for example, the power, luminance, and color values of the respective pixel when driven by the provided data signal. After the sensing period 102 expires, the sensing system 30 may cause the power driver 86A to resume the progressive scan 104. As such, the progressive scan 104 may be delayed by a data program delay 112 due to the sensing period 102.

In order to incorporate the sensing period 102 into the progressive scans of a display, pixel driving circuitry, in one embodiment, the sensing system 30 may transmit data signals to pixels of each row of the display 26 and may pause its transmission of data signals during any portion of the progressive scan to determine the sensitivity properties of any pixel on any row of the display 26. Moreover, as sizes of displays 26 decrease and smaller bezel or border regions are available around the display 26, integrated gate driver circuits may be developed using a similar thin film transistor process as used to produce the transistors of the pixels 82. However, to effectively use the integrated gate driver circuits to incorporate the sensing period 102 into the progressive scan 104, the sensing system 30 may include a pixel driving circuit 120, as provided in FIG. 8, for each row of pixels of the display 26.

Figure 8:
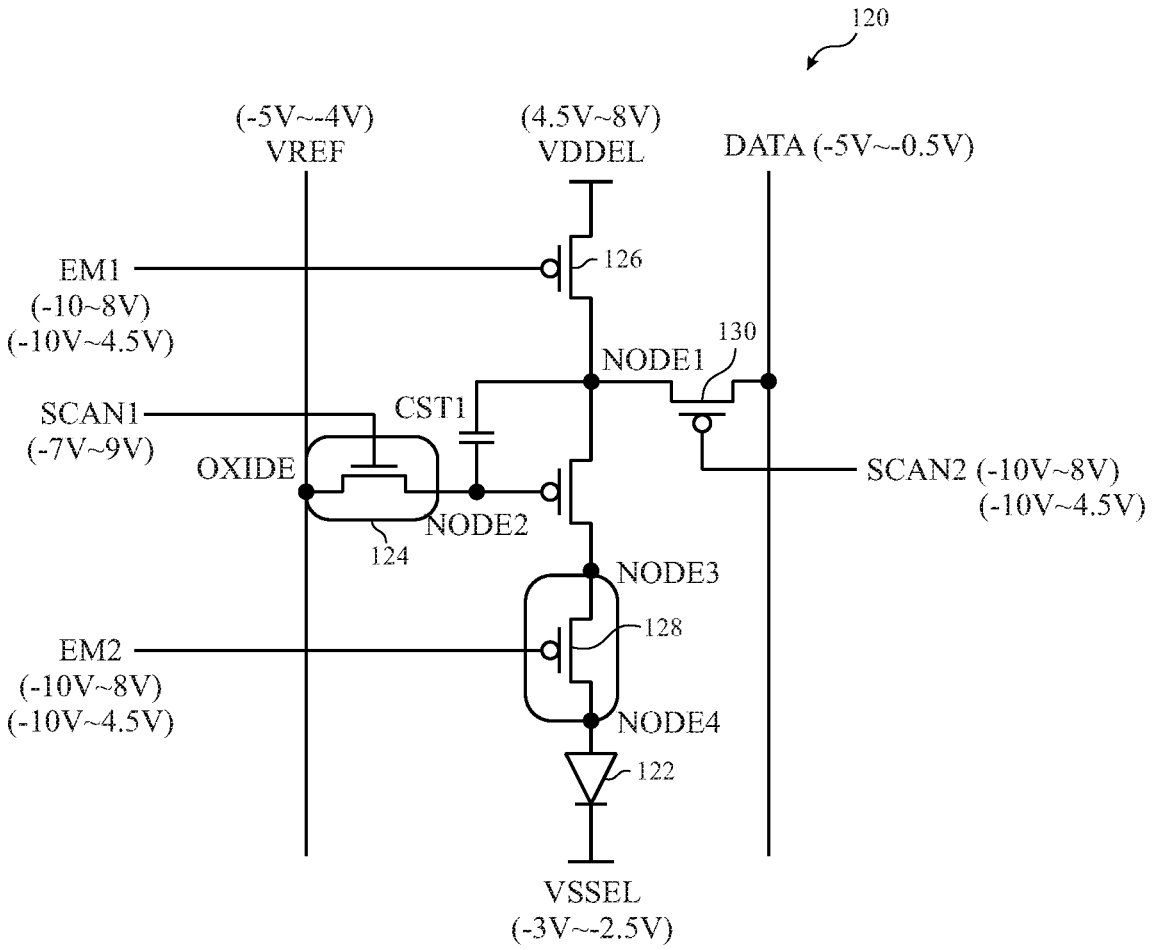
FIG. 8 is a circuit diagram of a pixel driving circuit that implements a sensing period while a progressive panel scan is being performed in the display of the electronic device of FIG. 1, in accordance with aspects of the present disclosure.

Referring to FIG. 8, the pixel driving circuit 120 may include a number of semiconductor devices that may coordinate the transmission of data signals to a light-emitting diode (LED) 122 of a respective pixel 82. In one embodiment, the pixel driving circuit 120 may receive four input signals (e.g., emission signals 1 and 2, scan signals 1 and 2), which may be coordinated in a manner to cause the pixel driving circuit 120 to perform the progressive scan for a respective row of pixels of the display 26, pause the progressive scan for the respective row of pixels, transmit a test data signal used to determine the sensitivity properties of the LED 122, and resume the progressive scan being performed on the display 26.

With this in mind, the pixel driving circuit 120 may include, in one embodiment, an N-type semiconductor device 124 and three P-type semiconductor devices 126, 128, and 130. Although the following description of the pixel driving circuit 120 will be discussed with the N-type semiconductor device 124 and the three P-type semiconductor devices 126, 128, and 130 described above, it should be noted that the pixel driving circuit 120 may be designed using any suitable combination of N-type or P-type semiconductor devices. That is, depending of the type of semiconductor devices used within the pixel driving circuit 120, the waveforms or signals provided to each semiconductor device should be coordinated in a manner to cause the pixel driving circuit 120 to pause the progressive scan for a row of pixels, transmit a data test signal to a respective pixel, and resume the progressive scan.

As shown in FIG. 8, the N-type semiconductor device 124 and the three P-type semiconductor devices 126, 128, and 130 may be driven by a first scan signal (Scan1), a first emission signal (EM1), a second emission signal (EM2), and a second scan signal (Scan2), respectively. Based on these four input signals, the pixel driving circuit 120 may implement a number of pixel driving schemes for a respective pixel. Four example pixel-driving schemes are illustrated in FIG. 9.

Figure 9:
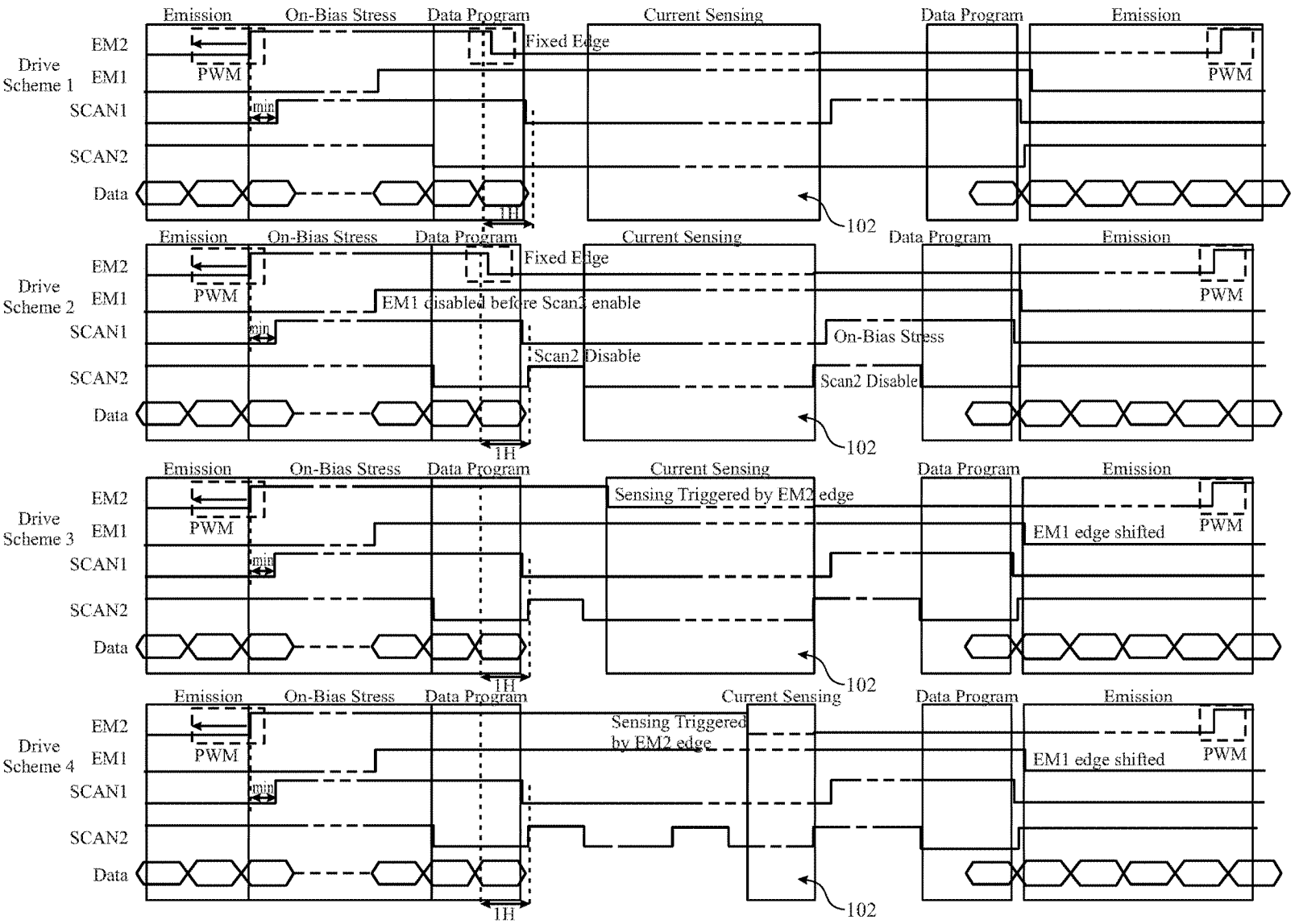
FIG. 9 is a collection of waveforms related to different driving schemes that may be implemented by the pixel driving circuit of FIG. 8 to provide a sensing period for a respective pixel of the display during a progressive panel scan, in accordance with aspects of the present disclosure.

Each pixel driving scheme depicted in FIG. 9 illustrate sample waveforms that may be used for the four control signals: first scan signal (Scan1), first emission signal (EM1), a second emission signal (EM2), and second scan signal (Scan2). The scan2 signal and the EM1 signal may be generated using standard shift register circuits where either the drain or the source of a buffer TFT is connected to a clock signal (CLK), and the other source or drain terminal is connected to the Scan2 line. As such, the clock (CLK) waveforms may be modified to realize a desired waveform for the EM1 signal, which may then be derived as inversion of the Scan2 signal.

In each pixel-driving scheme, the sensing period 102 for detecting current flow through a drive TFT of a respective pixel 82 may be enabled based on the Scan2 input signal or the EM2 signal. For instance, the sensing period 102 may be triggered by either the falling edge of the Scan2 input signal, as depicted in Drive Scheme 2, or on the falling edge of the EM2 signal, as depicted in Drive Schemes 3 and 4.

Regardless of the pixel-driving scheme employed to enable a respective pixel 82 to have a sensing period 102, the EM2 signal and the Scan1 input signal may transmit a first pixel data voltage to the respective pixel and then transmit a second data voltage that corresponds to the image data being depicted via the progressive scan. With this in mind, FIG. 10 illustrates example EM2 signal waveforms that may be transmitted to seven rows of pixels in the display 26, and FIG. 11 illustrates corresponding example Scan1 input signals that may be transmitted to the same seven rows of pixels.

Figure 10:
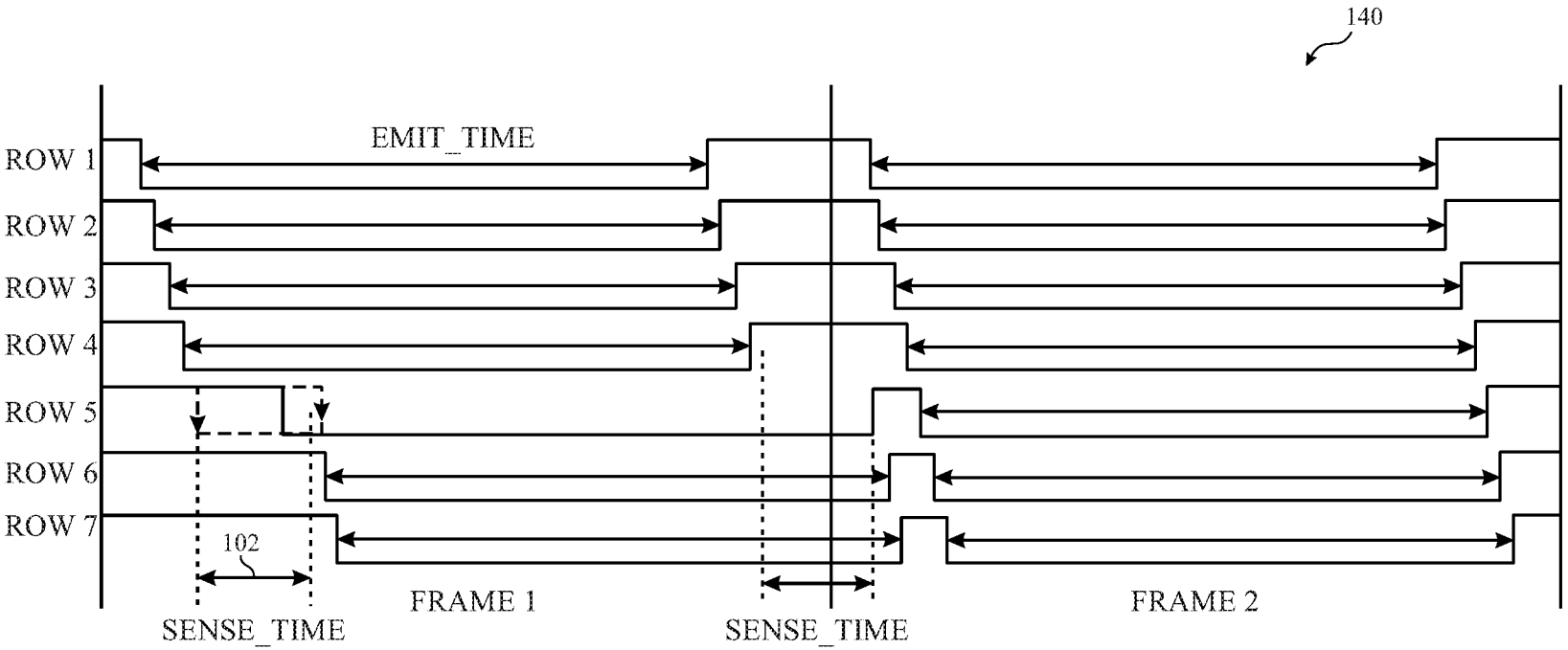
FIG. 10 is a collection of waveforms related to emission signals provided to a number of rows of a display by the pixel driving circuit to provide a sensing period for a respective pixel of the display during a progressive panel scan, in accordance with aspects of the present disclosure.
Figure 11:
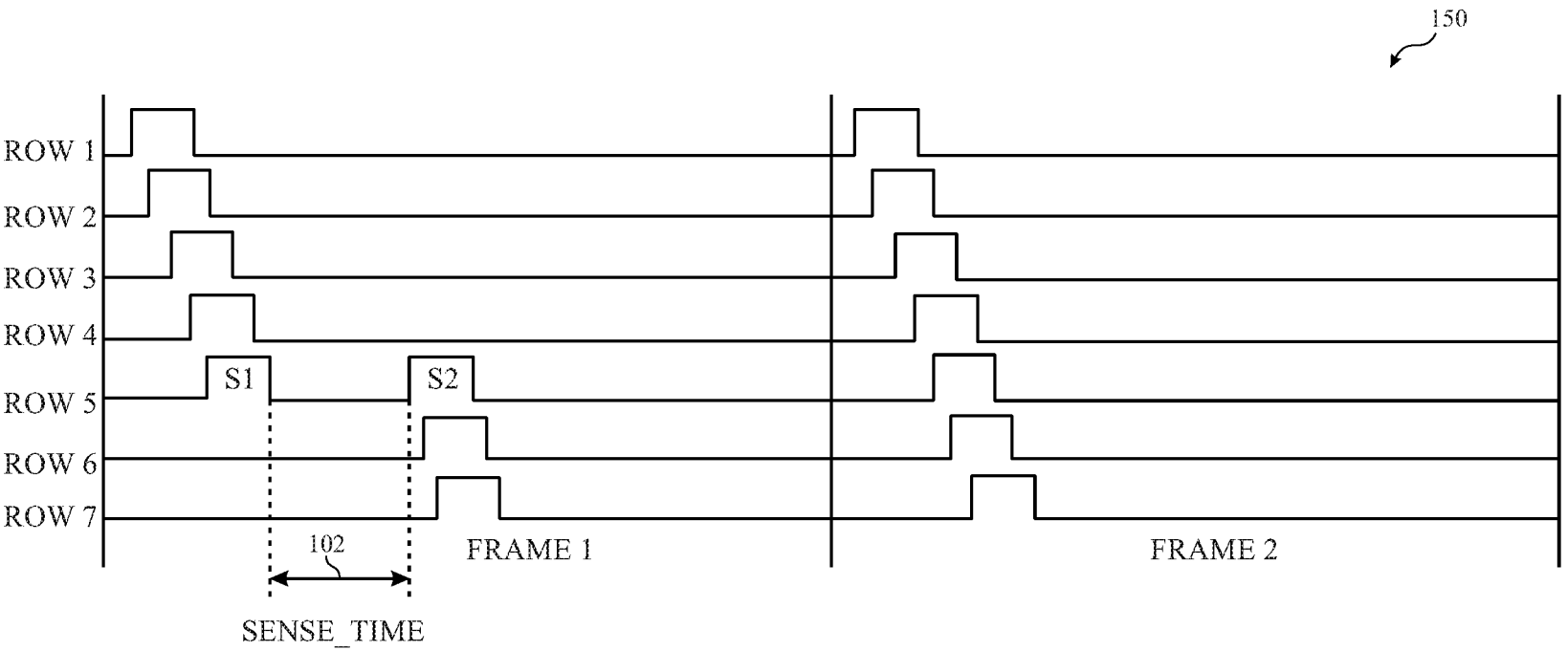
FIG. 11 is a collection of waveforms related to scan signals provided to a number of rows of a display by the pixel driving circuit to provide a sensing period for a respective pixel of the display during a progressive panel scan, in accordance with aspects of the present disclosure.

Referring first to FIG. 10, a collection 140 of example EM2 signals for seven rows of the display 26 is illustrated. It should be noted that the EM2 signals are provided to the P-type semiconductor device 128, and, as such, the P-type semiconductor device 128 is active or on when the EM2 signal is low. As shown in FIG. 10, the EM2 signals provided to row 1-4 are slightly offset with each other. That is, the EM2 signal provided to each row 2, 3, and 4 includes the same waveform but offset in time. As such, emission is enabled progressively one after the other for rows 1 to 4. The emission time (Emit Time) for each row may be fixed or variable depending upon ambient light level, grey scale, or other considerations.

To enable the sensing period 102 in row 5, the EM2 signal may be delayed by the amount of time that corresponds to the sensing period 102. That is, the emission turn-on signal (e.g., falling edge of EM2 signal) may be delayed by a certain amount of time (e.g., Sense_Time) for row 5. The progressive emission turn-on pattern then resumes at row 6 onwards, such that the turn-on period is offset by the same amount for each row of the display 26 during the following frame. As such, the rows following row 5 may have a turn-off period (e.g., high EM2 value) for a shorter duration as compared to the rows preceding row 5 in the frame immediately following the frame that included the sensing period 102.

It should again be noted that although the collection 140 of EM2 signal waveforms is detailed in FIG. 10 for the P-type semiconductor device (e.g., TFT) 128, it should be noted that the polarity of the EM2 signals can be reversed for N-type semiconductor devices.

During the sensing period 102, the pixel driving circuit 120 may transmit a Scan1 input signal that includes a first voltage that may be used to determine the sensitivity properties of the respective pixel 82 and a second voltage that corresponds to the data intended to be depicted during the progressive scan based on input image data. With this in mind, FIG. 9 illustrates a collection 150 of Scan1 input signals that may be transmitted to seven rows of the display 26. The following description of FIG. 11 should be read in light of the description of FIG. 10 above. It should be noted that the collection 140 of waveforms and the collection 150 of waveform are not to scale with respect to one another.

Referring to FIG. 11, the collection 150 of Scan1 input signal waveforms may represent pixel switch control signals for rows 1-7 of the display 26. The Scan1 input signal is provided to the N-type semiconductor device 124 of the pixel driving circuit 120. As such, a high Scan1 input signal may activate the N-type semiconductor device 124, while a low Scan1 input signal may turn off the N-type semiconductor device 124.

In any case, the Scan1 input signal may be used to apply a data voltage to capacitor Cst of the pixel driving circuit 120 or apply some reference voltage (Vref) on the other side of the capacitor Cst. In any case, during operation for rows 1 to 4, the progressive scan is enabled for each row progressively one after the other. When the pixel driving circuit 120 prepares to transmit the Scan1 input signal to the respective pixel 82 of row 5, the sensing system 30 may provide, in one example, a pre-defined pixel voltage (V1) (e.g., test data) during a first Scan1 input signal pulse (S1). The pre-defined pixel voltage (V1) may correspond to a pixel data voltage that enables the sensing system 30 to perform the real-time sensing techniques described herein for row 5. That is, instead of the progressive scan continuing at its expected time slot during the first Scan1 input signal pulse (S1), the sensing system 30 may coordinate with the pixel driving circuit 120 to provide the pre-defined pixel voltage (V1) when the pixel driving circuit 120 would otherwise provide the pixel data voltage (V2) that corresponds to the image data to be depicted in the respective pixel 82.

After transmitting the pre-defined pixel voltage (V1), the sensing system 30 may retrieve data regarding certain properties (e.g., luminance, color) associated with the respective pixel 82 based on the pre-defined pixel voltage (V1). After transmitting the pre-defined pixel voltage (V1) during the first Scan1 input signal pulse (S1), the sensing system 30 may cause the pixel driving circuit 120 to transmit pixel data voltage (V2) during the second Scan1 input pulse (S2). As mentioned above, the pixel data voltage (V2) may correspond to the intended image data to be depicted on the respective pixel 82 in accordance with the progressive scan previously being performed. In other words, the progressive scan may resume at the second Scan1 input pulse (S2) and for the remaining rows of the display 26.

In some embodiments, the sensing system 30 may determine sensitivity properties regarding each pixel in the display 26 during the progressive scan at different frames of image data. The sensing system 30 may the store data related to the properties associated with each pixel. Using the stored data, the sensing system 30 may determine whether each pixel reacts to the pre-defined voltage in the same manner (e.g., output of power, luminance). The sensing system 30 may determine a compensation factor or voltage for each pixel to enable each of the pixels in the display 26 to display a uniform color and luminance when receiving the same input voltage. In one embodiment, the sensing system 30 may then apply the determined compensation factor or voltage to data voltage related to image data to be depicted by each pixel. As a result, the pixels of the display 26 may exhibit substantially similar luminance, color, and power properties when provided the same original data voltage inputs.

It should be understood that although preceding description of the Scan1 input signal is described with respect to the N-type semiconductor device 124, it should be noted that the polarity of the Scan1 input signals can be reversed when used with a corresponding P-type semiconductor device.

Figure 12:
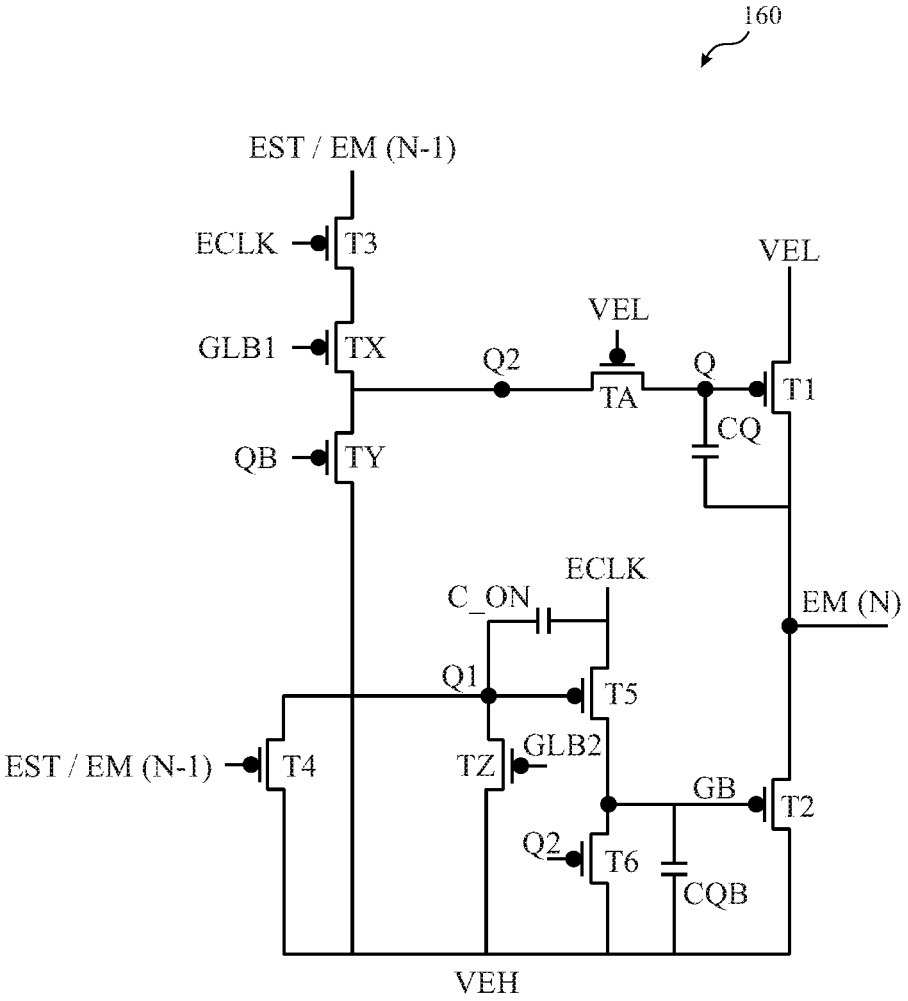
FIG. 12 is a circuit diagram of an emission signal waveform generator that provides an emission signal to the respective pixel to a respective pixel of the display during a progressive panel scan, in accordance with aspects of the present disclosure.

With the foregoing descriptions of FIGS. 10 and 11 in mind, FIG. 12 illustrates an embodiment of an EM2 signal waveform generator circuit 160 that may be used to provide the EM2 signal described above with reference to FIG. 10. The circuit 160 may include a 2-phase EM integrated gate driver circuit (e.g., high emission voltage (VEH) and low emission voltage (VEL)), which enables pulse-width modulation (PWM) based emission control, and three additional thin film transistors (TFTs): Tx, Ty, and Tz. The additional TFTs may enable the total emission time for each row following the row having the pixel being sensed to be the same as each other while incorporating the sense time delay of the sensing period 102.

In one embodiment, a first global signal (GLB1) may be positioned in a manner to delay VEH to VEL transition on all EM lines downstream of the row (n) that corresponds to the row having the pixel having its sensitivity properties being evaluated. Generally, the TFT Ty may provide positive feedback between nodes Q2 and QB to ensure that VEL to VEH transitions on the EM2 signal occur when the first global signal (GLB1) is provided to the TFT Tx.

A second global signal (GLB2) may provide an extended start pulse for the EM2 signal (n) provide to the sensing row (n). In this way, the EM2 signal output of each row may act as a start pulse for the next row. In other words, the EM2 signal for row (n−1) may act as a start pulse for the EM2 signal for row (n). However, due to the sensing time or sensing delay associated with the sensing period 102, the EM2 signal should enable emission (e.g., on emission) for the row (n) even when the EM2 signal for the row (n−1) is already off when an emission clock signal (ECLK) is high. To circumvent this issue, the second global signal (GLB2) is provided to the TFT Tz for the sensing time.

The operation of the EM2 signal waveform generator circuit 160 based on the two global signals may be as follows. If the two global inputs are low, the EM2 signal waveform generator circuit 160 may transition into a low emission voltage (VEL) state. If the two global signals are high, the EM2 signal waveform generator circuit 160 may transition into a high emission voltage (VEH) state. If the first global signal (GLB1) is low and the second global signal (GLB2) is high, the EM2 signal waveform generator circuit 160 may maintain an expected emission operation. Moreover, if the first global signal (GLB1) is high and the second global signal (GLB2) is low, the EM2 signal waveform generator circuit 160 may retain the current state of the emission signal.

During the sensing operation, the VEL and the VEH edge may be shifted by the sensing time. To ensure proper operation of the EM2 signal waveform generator circuit 160, a minimum EM high (VEH) pulse to disable the emission may be 2H+sensing time. That is, 1H is the line time to apply desired data voltage that corresponds to the desired image to one row of the pixel. If there are N rows in the panel, there will be N line times or N*1H time.

Like the pixel driving circuit 120, although the EM2 signal waveform generator circuit 160 is illustrated using P-type semiconductor devices, it should be noted that these devices may be replaced with N-type semiconductor devices when the VEL and VEH are interchanged and when the polarities of the emission clock signal (ECLK), the global signal (GLB1), and the global signal (GLB2) is reversed.

Figure 13:
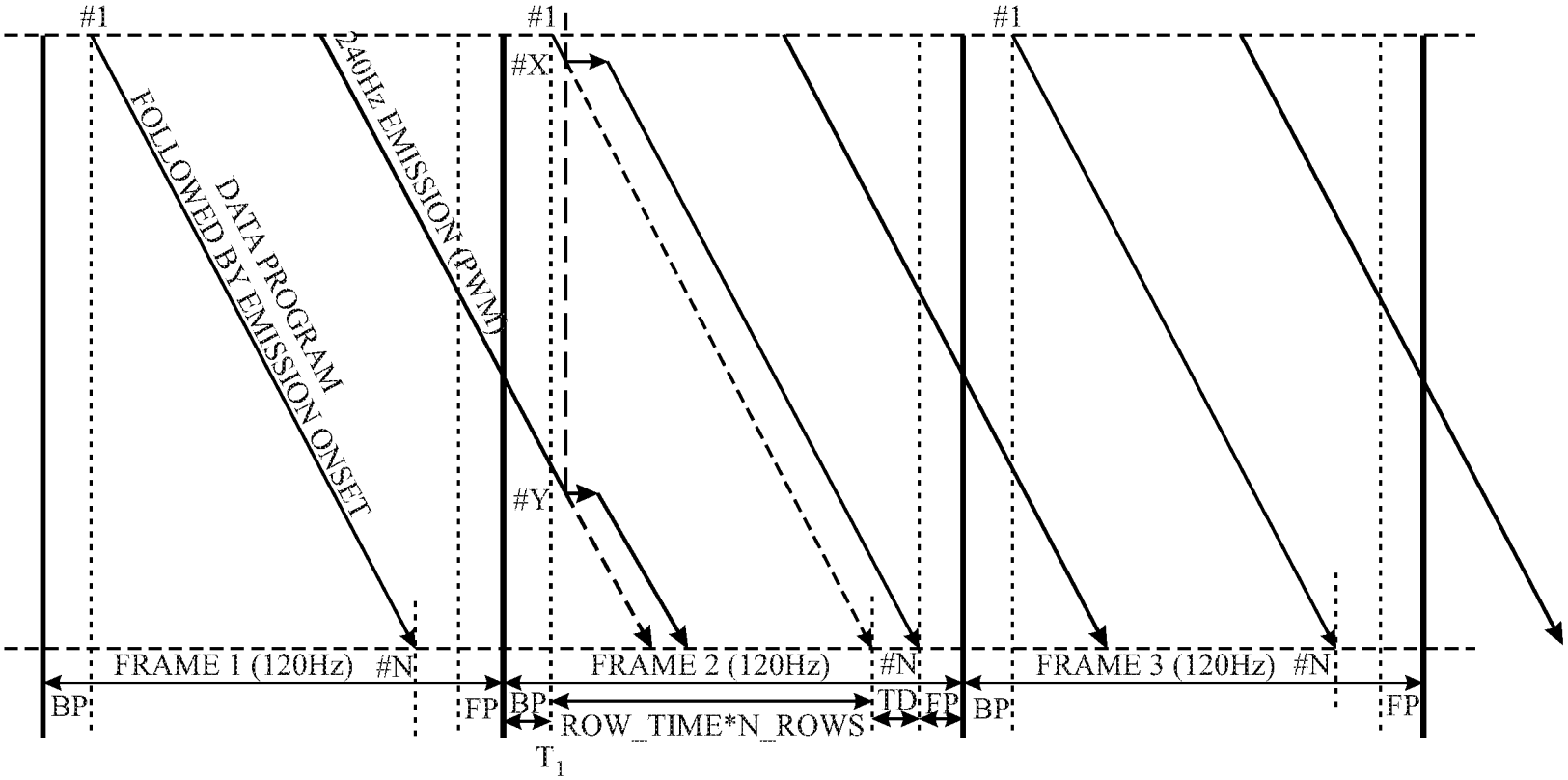
FIG. 13 illustrates a timing diagram that represents a progressive scan of a data program being performed on the display at a first frequency while an emission signal for real-time sensing is provided to the display at a second frequency, in accordance with an embodiment.

As a result of using the EM2 signal waveform generator circuit 160 as described above, the pixel driving circuit 120 may be capable of pausing the progressive scan of the display 26, as depicted in FIG. 7. However, in some instances when the emission rate (e.g., 240 Hz) is faster than the data refresh rate (e.g., 120 Hz), using a single global signal (GLB1) to create an emission time that enables real-time sensing may be extended for an unintended row. For example, FIG. 13 illustrates a timing diagram that represents a progressive scan of a data program being performed on the display 26 at 120 Hz while the EM2 signal for real-time sensing is provided to the display 26 at 240 Hz. As seen in FIG. 13, because the EM2 signal is provided at 240 Hz, the emission time delay at time t1 for real-time sensing in row Y creates a similar emission time delay for row X for the progressive scan of the data program. To avoid affecting the progressive scan of the data program in the display 26 when performing the real-time sensing techniques described herein with respect to the EM2 signal provided to the display 26, the sensing system 30 may adjust the operation of the pixel driving circuit 120 as will be detailed below.

Figure 14:
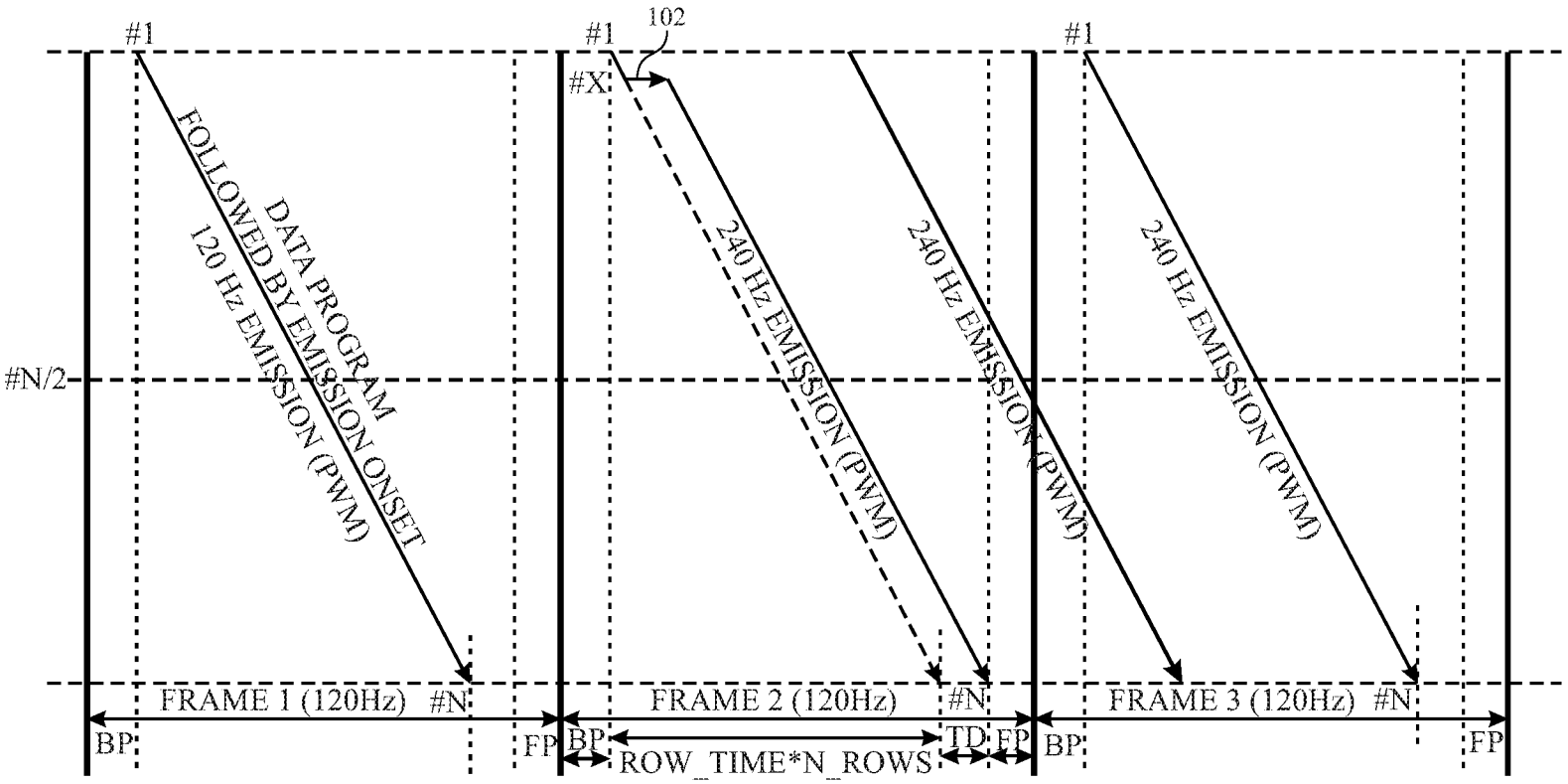
FIG. 14 illustrates a timing diagram that represents a progressive scan of a data program being performed on the display at a first frequency while an adjusted emission signal for real-time sensing is provided to the display at a second frequency to accommodate the data program of a pixel in the top half of the display, in accordance with an embodiment.

In one embodiment, to prevent the emission delay time provided by the EM2 signal from delaying the progressive scan of the data program, the sensing system 30 may disable the EM2 signal in a preceding frame when real-time sensing is to be performed for a row in a top half of the display 26 for a particular frame. For instance, FIG. 14 illustrates the data program of a progressive scan being performed in the first frame and a sensing period 102 being added to the data program of the progressive scan during a second frame. In comparison to the data program illustrated in FIG. 13, the EM2 signal preceding the data program of frame 2 is disabled to prevent two rows from experiencing the sensing period 102 at the same time.

Figure 15:
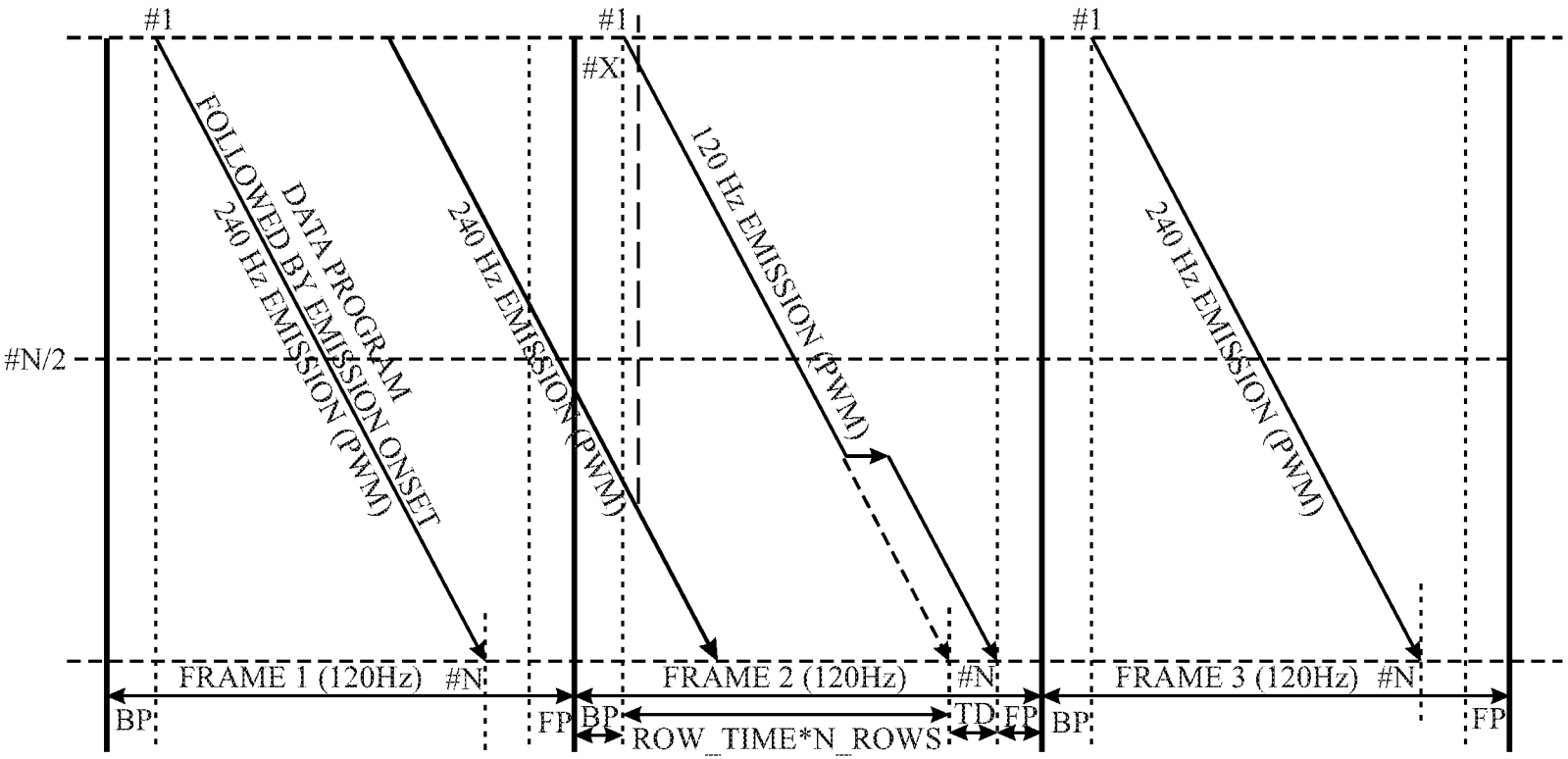
FIG. 15 illustrates a timing diagram that represents a progressive scan of a data program being performed on the display at a first frequency while an adjusted emission signal for real-time sensing is provided to the display at a second frequency to accommodate the data program of a pixel in the bottom half of the display, in accordance with an embodiment.

In another embodiment, if the sensing period is to be performed on a row of the display 26 in the bottom half of the display 26, the sensing system 30 may cause the pixel driving circuit 120 to disable the EM2 signal in the frame that includes the respective row being sensed. For instance, FIG. 15 illustrates the data program of a progressive scan being performed in the first frame, followed by the EM2 signal being transmitted in between the first and second frames, and a sensing period 102 being added to the data program of the progressive scan during a third frame and a bottom half of the display 26. As shown in FIG. 15, the EM2 signal that would have been transmitted following the data program of frame 2 is disabled to prevent two rows from experiencing the sensing period 102 at the same time.

Figure 16:
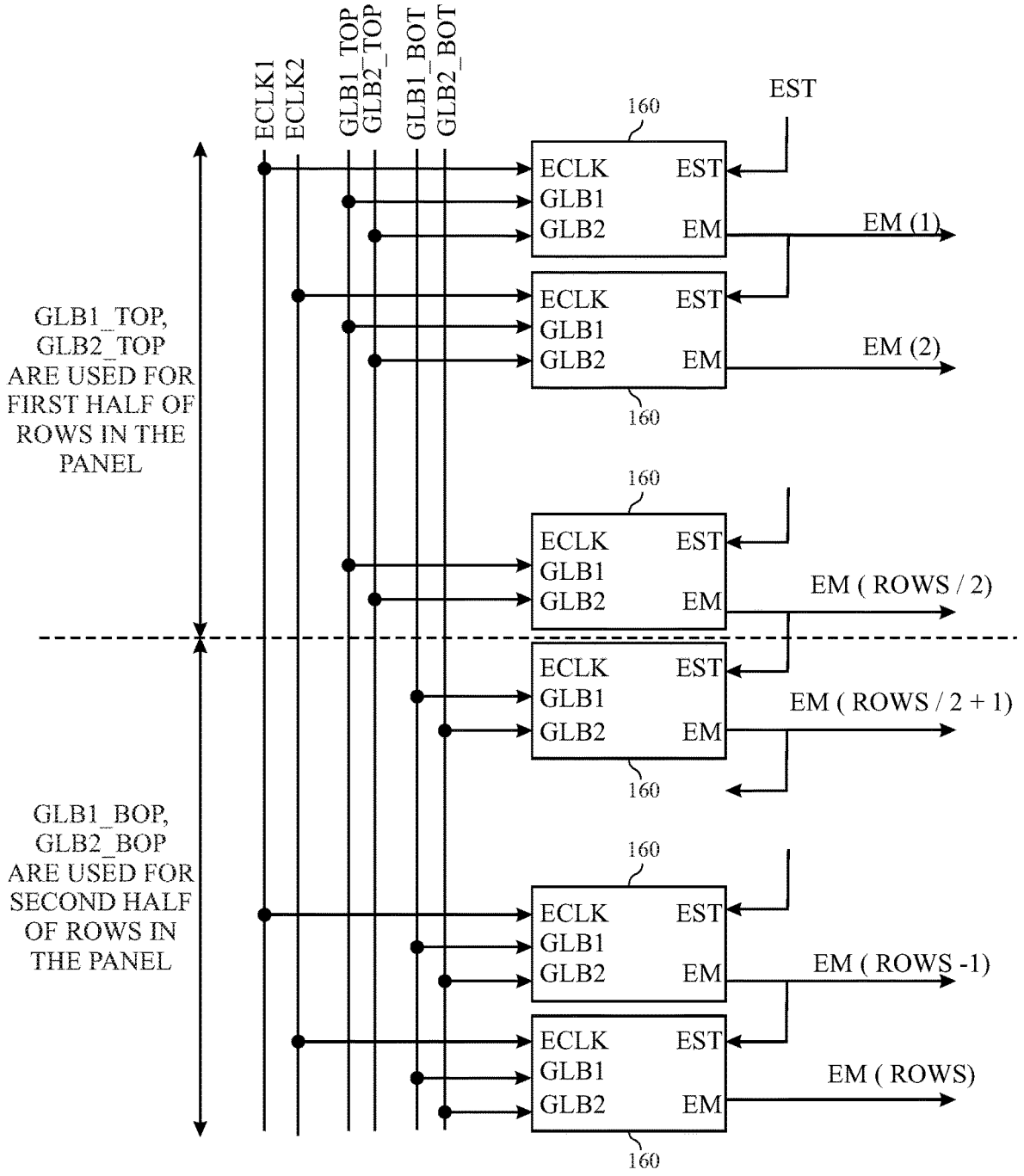
FIG. 16 illustrates an example block diagram of a number of emission signal waveform generators that may be employed to transmit emission signals to the display, in accordance with an embodiment.

In yet another embodiment, the sensing system 30 may provide separate global signals for the top and bottom halves of the display 26. Referring briefly back to FIG. 12, two global signals (e.g., GLB1 and GLB2) may be employed for the EM2 signal generator 160. With this in mind, FIG. 16 illustrates an example block diagram of a number of EM2 signal generators 160 that may be employed to transmit EM2 signals to the display 26. As shown in FIG. 16, the top half of the display 26 may use two global signals (e.g., GLB1_TOP and GLB2_TOP) as inputs into respective EM2 signal generators 160, and the bottom half of the display 26 may use two global signals (e.g., GLB1_BOT and GLB2_BOT) as inputs into respective EM2 signal generators 160. In this way, since the global signals are separated for the top and bottom halves of the display 26, the sensing performed in one half of the display 26 does not impact the emission time on onset in the other half of the display 26.

Figure 17:
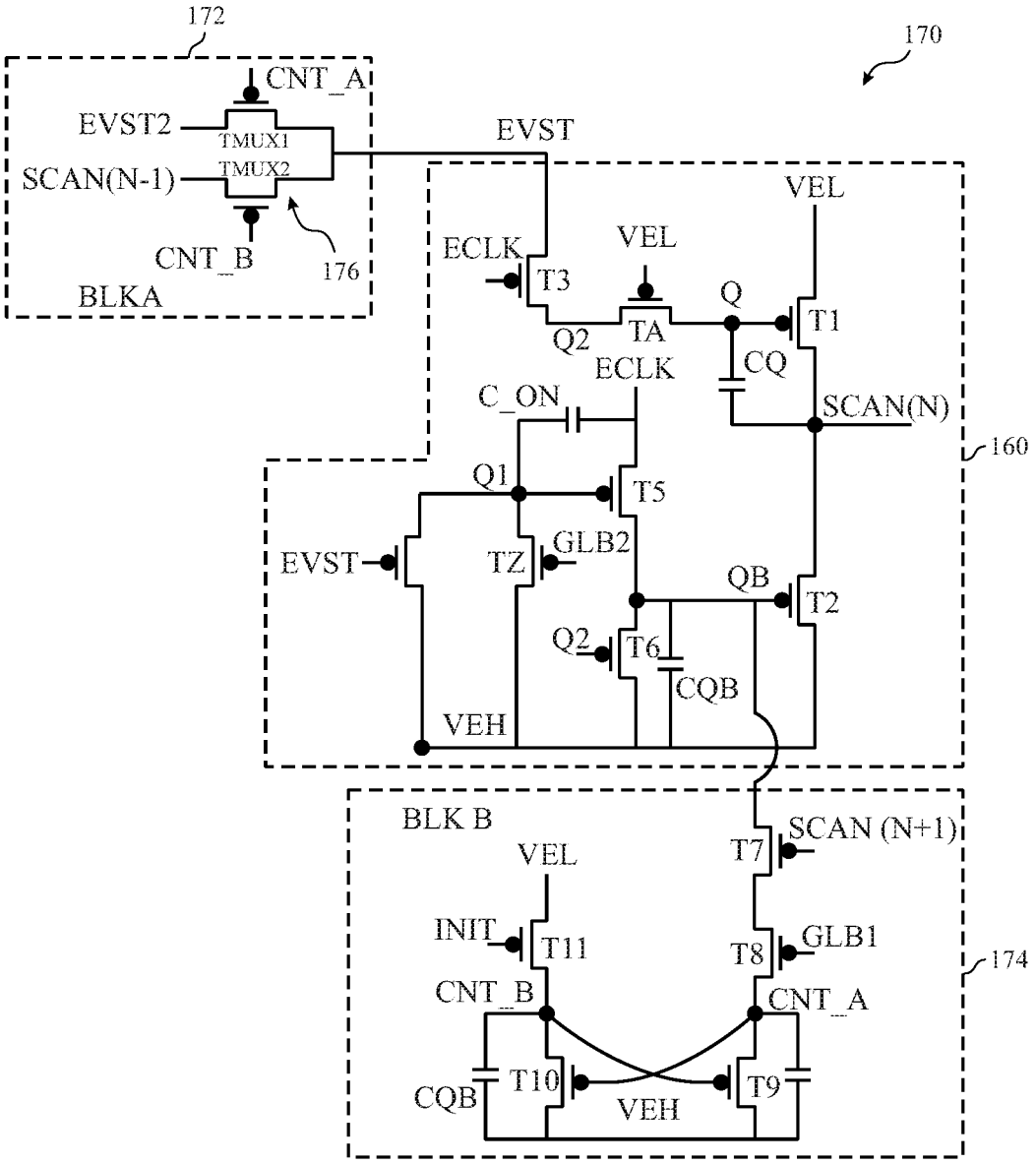
FIG. 17 illustrates an example circuit diagram for a input signal generator that may be coupled to the emission signal generator of FIG. 12, in accordance with aspects of the present disclosure.

With the foregoing in mind, FIG. 17 illustrates an example circuit diagram for a Scan1 input signal generator 170 that may be coupled to the EM2 signal generator 160. The Scan1 input signal generator 170 may include circuit block 172 and circuit block 174, both of which may be coupled to different portions of the EM2 signal generator 160. The circuit block 172 may receive two signals, each of which may emit a start pulse (EVST1) to the EM2 signal generator 160. One of the two signals provided to the circuit block 172 may include a global start pulse (EVST2) for starting a sensing period 102 in a pixel of a row in the display 26. The other signal provided to the circuit block 172 may include a Scan input signal provided via a previous stage (e.g., frame, row).

To determine which source to use to initiate the start pulse (EVST), a 2:1 de-multiplexer 176 may be implemented with two control signals (e.g., CNT_A and CNT_B). In one embodiment, these two control signals may be locally generated in the circuit block 174. According to the circuit block 174, the second control signal (CNT_B) is enabled (e.g., low) or disabled (e.g., high) based on whether a global signal (INIT) is equal to a low emission level (VEL).

Figure 18:
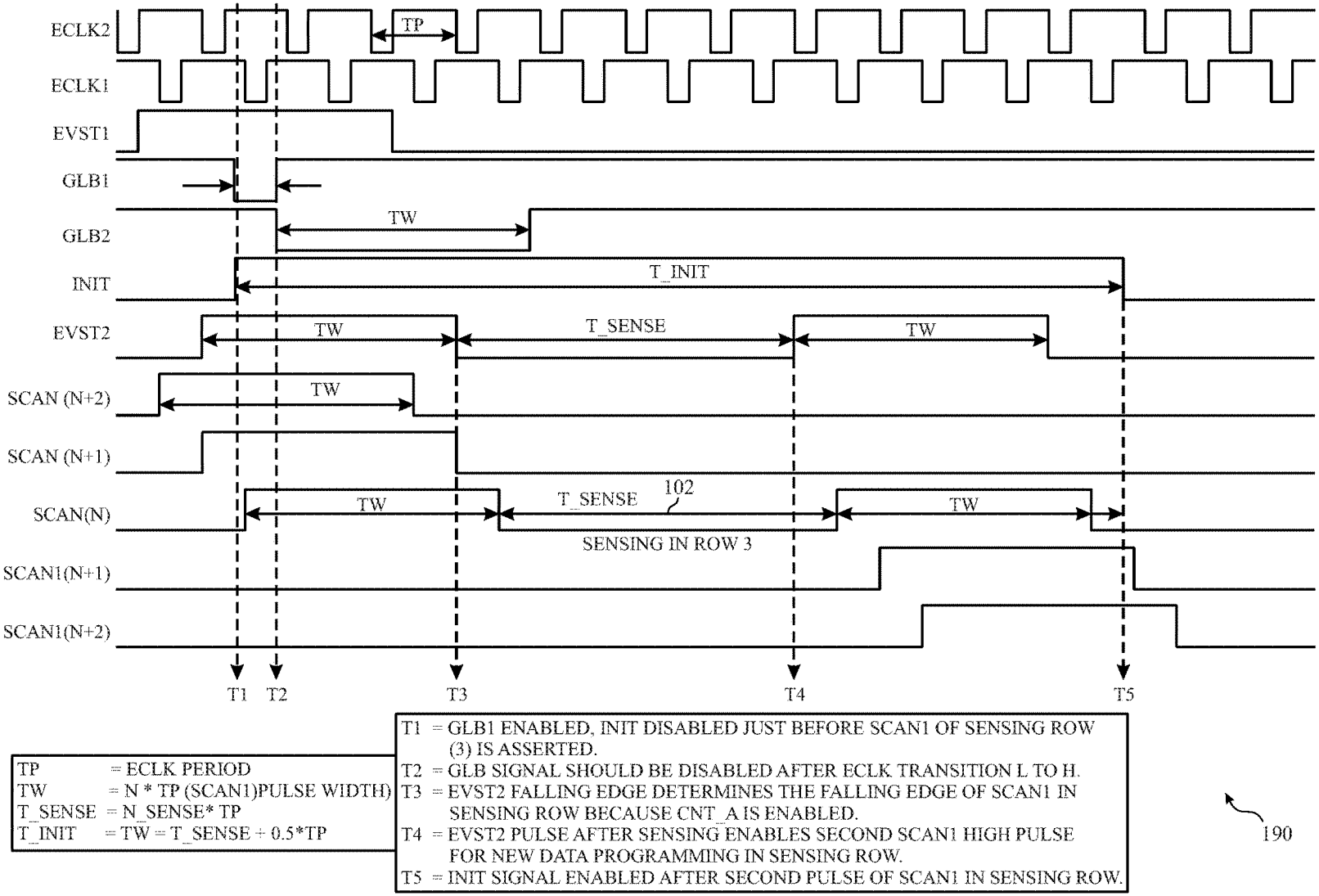
FIG. 18 illustrates a timing diagram that represents the operation of the input signal generator of FIG. 17, in accordance with an embodiment.

To enable sensing for row N of the display 26, the sensing system 30 may transition the first global signal (GLB1) signal from high to low at t1, as illustrated in FIG. 18. According to the Scan1 input signal generator 170, when the first global signal (GLB1) signal, QB(n), and Scan (N+1) are low, the polarity of the first control signal (CNT_A) and the second control signal (CNT_B) may flip. As a result, for row N, the start pulse (EVST1) may be derived from the global start pulse (EVST2). This helps to delay the start of data programming from row N after the sensing (T_sense) has been performed. The first global signal (GLB1) may remain high to prevent row (N+1) and subsequent rows from activating (e.g., high) during the sensing period 102.

FIG. 18 illustrates a timing diagram 190 that represents the operation of the Scan1 input signal generator 170. At time t1, the first global signal (GLB1) may be enabled (low) and the initialization signal (INIT) may be disabled (high) just before the Scan1 signal (SCAN (N)) is provided to row N. At time t2, the first global signal (GLB1) may be disabled after the second clock signal (ECLK2) transitions from low to high.

At time t3, the falling edge of the global start pulse (EVST2) may determine the falling edge of the Scan1 signal for row N because the control signal (CNT_A) may be enabled. Afterwards, at time t4, the global start pulse (EVST2) may enable the second Scan1 signal for row N. The first Scan1 signal provided just after time t1 may program the pre-defined pixel voltage (V1), as discussed above. The second Scan1 signal just after time t4 may then provide the pixel data voltage (V2) that corresponds to the image data to be depicted in the respective pixel 82. At time t5, the initialization signal (INIT) may be enabled (low) after the second pulse of the Scan1 signal for row N. As a result, the remaining rows after row N may continue receiving their respective pixel data voltages as per the image data.

It should be noted again that the Scan1 input signal generator 170 may also be implemented using N-type semiconductor devices if the P-type semiconductor devices are replaced by N-type semiconductor devices, and the high emission voltage (VEH) and low emission voltage (VEL) are interchanged. In addition, the polarities of the clock signal (ECLK), the global signals (GLB1 and GLB2), the initialization signal (INIT), and the start signal (EVST) are reversed. In some embodiments, the global signals (GLB1 and GLB) may be split into multiple signals. That is, the first global signal (GLB1) may be split into a first odd global signal (GLB1_odd) and a first even global signal (GLB1_even) for even and odd stages (e.g., rows). Similarly, the sensing system 30 may also generate two separate global signals for the top half and the bottom half of the display such as signals (GLB1_1 and GLB1_2) for global signal (GLB1) and signal (GLB2_1 and GLB2_2) for global signal (GLB2).

Figure 19:
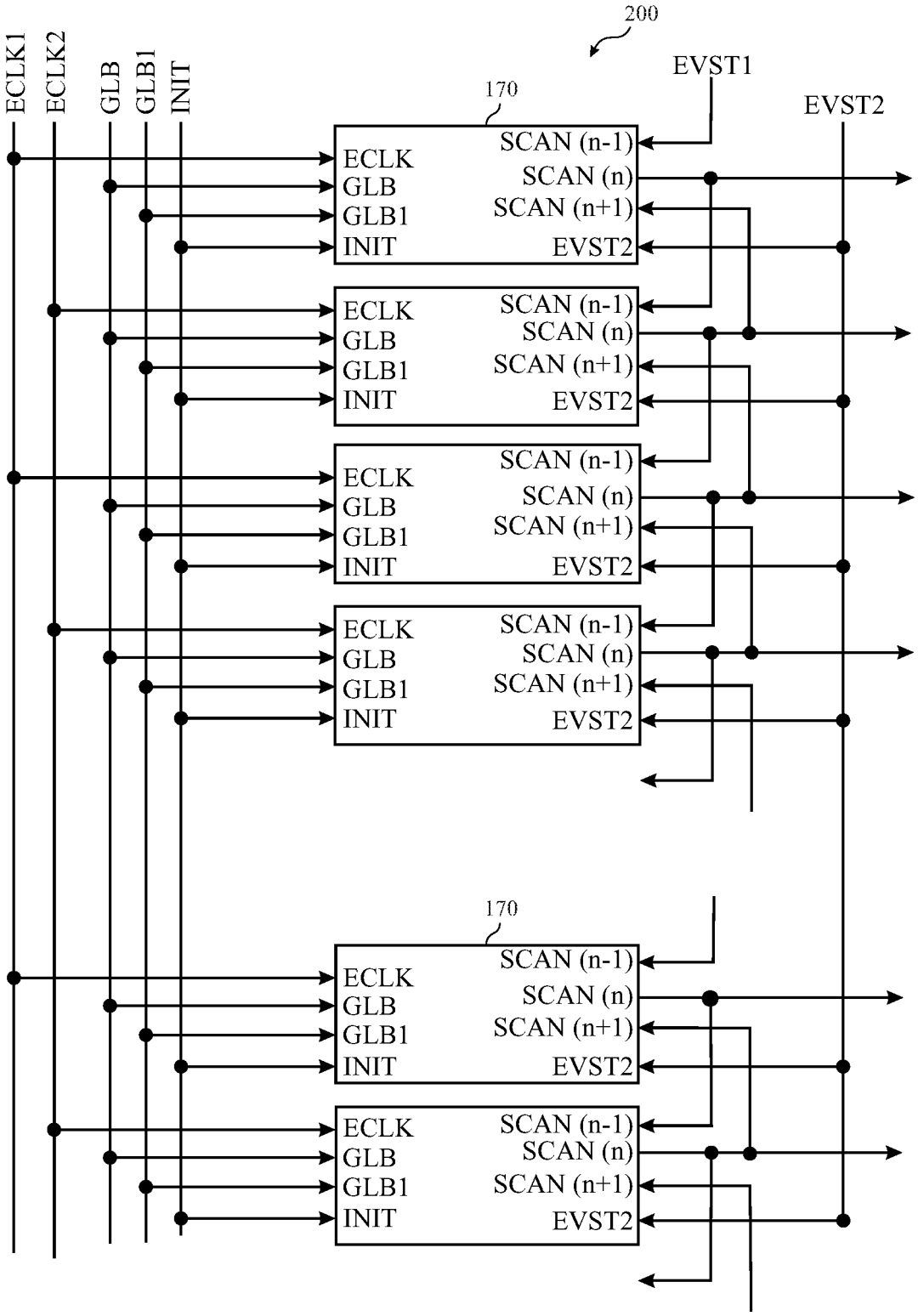
FIG. 19 illustrates a circuit block diagram that represents how input signals may be provided to the input signal generator of FIG. 17, in accordance with an embodiment.

With the foregoing in mind, FIG. 19 illustrates a circuit block diagram 200 that represents how input signals (ECLK1, ECLK2, GLB1, GLB2, INIT) may be provided to the Scan1 input signal generator 170 for each row N of the display 26. In addition, the circuit block diagram 200 illustrates the outputs of the Scan1 input signal generator 170 and the manner in which each output is routed to other Scan1 input signal generators 170 for driving each row of the display 26.

The circuitry described above is related to systems and method for incorporating a sensing period during a progressive scan. In some embodiments, it may be useful to incorporate multiple sensing periods for a particular row of pixels on the display 26. With this in mind, the previously described pixel driving circuit 120, as provided in FIG. 8, may not be capable of implementing multiple sensing periods for any particular row of pixels. That is, as discussed above, the pixel driving circuit 120 may initiate the sensing period 102 based on either the falling edge of the Scan2 input signal or on the falling edge of the EM2 signal. The rising edge of the Scan2 input signal may then be used to resume the progressive scan for the remaining rows of the display 26, as illustrated in the different driving scheme depicted in FIG. 9.

Figure 20:
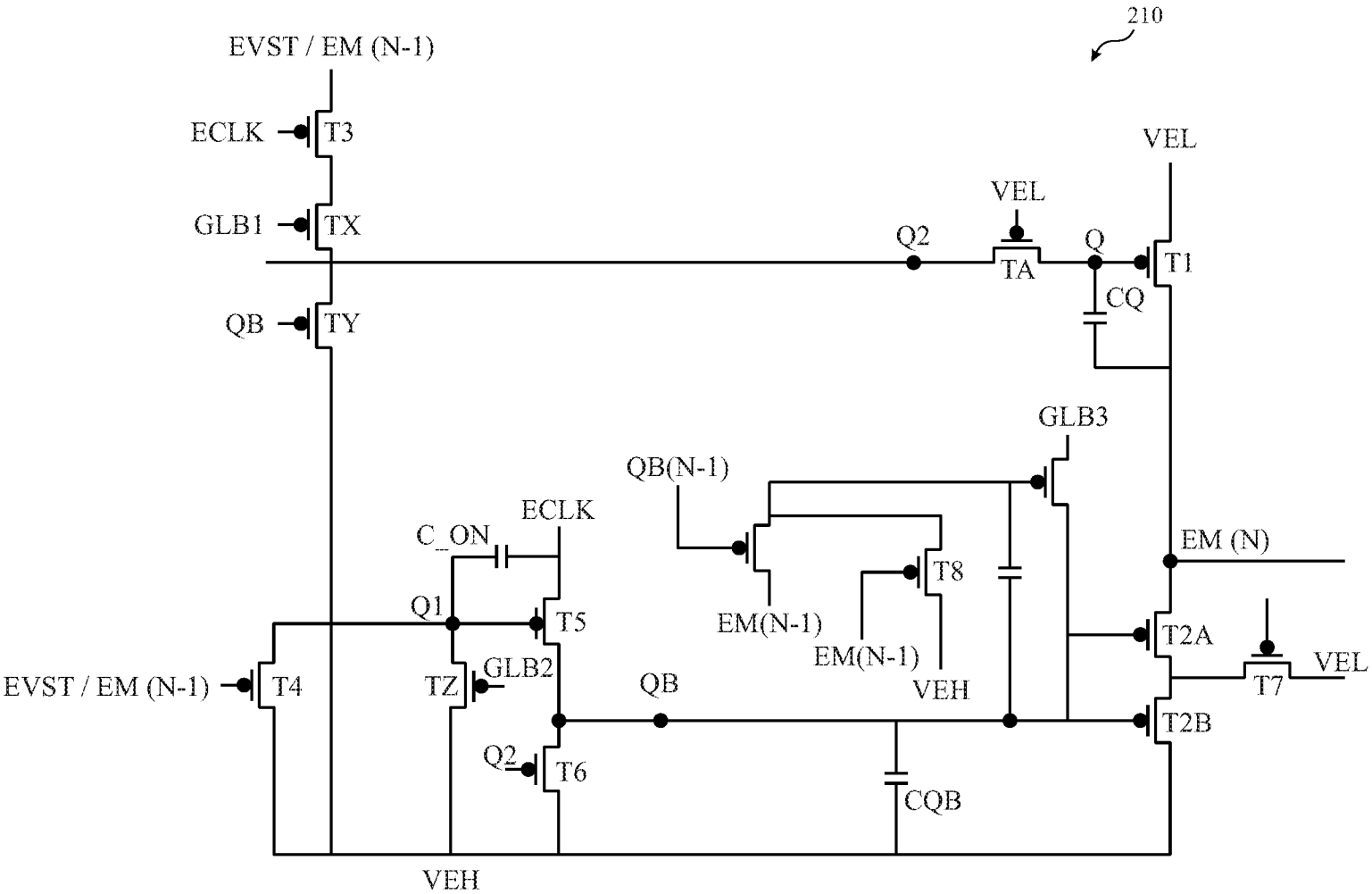
FIG. 20 is a circuit diagram of an emission signal waveform generator that provides an emission signal to the respective pixel to a respective pixel of the display during a progressive panel scan, in accordance with aspects of the present disclosure.

Keeping this in mind, in some instances, the TFTs of the various circuits described above may experience the hysteresis effect due to capacitance voltages and other residual electrical and magnetic properties present on the circuit. As such, in certain embodiments, the EM2 signal waveform generator circuit 160 of FIG. 12 may be modified to include additional circuit components that enable the display 26 to implement multiple sensing periods 102 during the progressive scan. That is, the sensing system 30 may employ an EM2 signal waveform generator circuit 210, as illustrated in FIG. 20, to perform multiple toggles of the sensing period 102, thereby providing the opportunity to apply some reference voltage (Vref) on the capacitor Cst of the pixel driving circuit 120 multiple times. By providing the ability to perform the real-time sensing techniques described herein during multiple sensing periods 102, the waveform generator circuit 210 may improve the ability of the sensing system 30 to determine the sensitivity properties associated with a pixel.

In some embodiments, the EM2 signal waveform generator circuit 210 may be arranged like the EM2 signal waveform generator circuit 160 of FIG. 12 with additional circuitry that uses a third global signal (GLB3) to implement multiple sensing periods 102 during a progressive scan. For the purposes of discussion, FIG. 21 illustrates a timing diagram 220 related to emission signals provided to a number of rows of the display 26 by the pixel driving circuit to provide multiple sensing periods 102 for a respective pixel 82 of the display 26 during a progressive panel scan, in accordance with aspects of the present disclosure.

Figure 21:
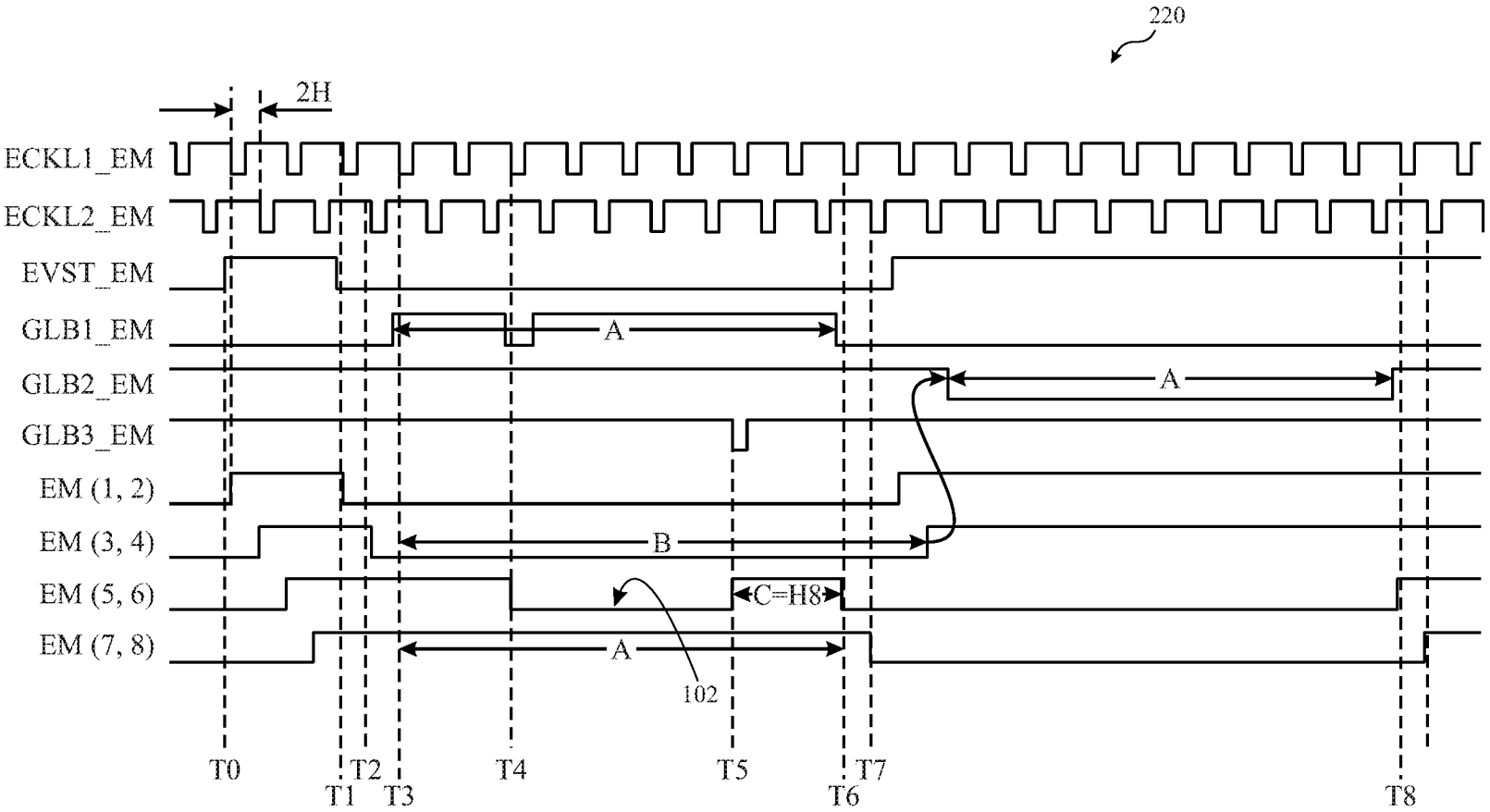
FIG. 21 illustrates a timing diagram related to emission signals provided to a number of rows of the display by the pixel driving circuit to provide multiple sensing periods for a respective pixel of the display during a progressive panel scan, in accordance with aspects of the present disclosure.

Referring to FIGS. 20 and 21, in operation, the EM2 signal waveform generator circuit 210 may operate similarly to the EM2 signal waveform generator circuit 160 of FIG. 12. That is, in some embodiments, a first global signal (GLB1) may be positioned in a manner to delay VEH to VEL transition on each EM line downstream of the row (n) that corresponds to the row having the pixel having its sensitivity properties being evaluated. Generally, the TFT Ty may provide positive feedback between nodes Q2 and QB to ensure that VEL to VEH transitions on the EM2 signal occur when the first global signal (GLB1) is provided to the TFT Tx. In addition, the second global signal (GLB2) may provide an extended start pulse for the EM2 signal (n) provide to the sensing row (n). In this way, the EM2 signal output of each row may act as a start pulse for the next row. That is, the EM2 signal for row (n−1) may act as a start pulse for the EM2 signal for row (n).

However, due to the sensing time or sensing delay associated with the sensing period 102, the EM2 signal should enable emission (e.g., on emission) for the row (n) even when the EM2 signal for the row (n−1) is already off when an emission clock signal (ECLK) is high. To avoid this issue, the second global signal (GLB2) is provided to the TFT Tz during the sensing period 102. That is, the second global signal GLB2 remains high and prevents TFT Tz from turning on and transitioning the EM2 signal waveform generator circuit 210 to a high emission voltage (VEH) state until the third global signal GLB3 is pulsed to a low voltage level.

For example, referring to the timing diagram 220 of FIG. 21, at time t0, a start pulse (EVST_EM) may be provided to the EM2 signal waveform generator circuit 210 while the first global signal GLB1 is low. As such, when the first emission clock signal (ECLK1_EM) is pulsed to a low voltage state, the scan lines 1 and 2, which are coupled to the output of the EM2 signal waveform generator circuit 210 become active (e.g., capable of emission). At time t1, the start pulse EVST_EM may return to a low state and thus cause the scan lines 1 and 2 to return to an inactive state upon the falling edge of the first emission clock signal ECLK1_EM. Since the previous emission signals provided to preceding scan lines may be provided to the EM2 signal waveform generator circuit 210 at the source side of the TFT T3, when the emission signals to scan lines 1 and 2 are removed (e.g., transition from high to low at time t1), the emission signals to scan lines 3 and 4 may return to a low voltage state at time t2 after the second emission clock signal ECLK2_EM transitions from high to low, thereby turning off TFT T1.

To enable a respective pixel 82 coupled to the EM2 signal waveform generator circuit 210 to implement a sensing period 102, the first global signal GLB1 transitions to a high voltage state just before time t3 when the first emission clock signal ECLK1_EM goes low, while the start pulse EVST_EM is in a low voltage state. At time t3, although the first emission clock signal ECLK1_EM is low, the emission signals for scan lines 5 and 6 remain high (e.g., VEH) because the first global signal GLB1 transitions is in a high voltage state, thereby preventing TFT T1 from turning off and the emission signals for scan lines 5 and 6 from going low (e.g., VEL).

However, just before time t4, the first global signal GLB1 may return to a low voltage state, thereby turning TFT TX on. As such, at time t4 when the first emission clock signal ECLK1_EM returns to a low voltage state to allow the respective pixel associated with scan line 5 or 6 with the sensing period 102. That is, the respective pixel may not display color data, but instead perform sensing operations, as discussed above.

By way of operation, the EM2 signal waveform generator circuit 210 may use a low voltage pulse provided by the third global signal GLB3 at time t5 to terminate the sensing period 102 for the scan lines 5 and 6. That is, just before time t5, the emission signals to scan lines 3 and 4 are at a low voltage state thereby connecting the high voltage (VEH) to the gate of the TFT T5 via the TFT T4. Moreover, at time t5, the emission signals for scan lines 5 and 6 may return to an off state to enable the respective pixel to receive a data voltage that corresponds to the desired pixel voltage for the respective image data to be depicted via the display 26.

With this in mind, just before time t5, TFT T4 remains open and node QB is in a low voltage state and the third global signal GLB3 is provided to the gates of TFTs 2*a* and 2*b* via the TFT T11. Since the third global signal GLB3 transitions to a low voltage state at time t5, the TFTs 2*a* and 2*b* close at time t5 and return the emission signals for scan lines 5 and 6 to a high voltage state (VEH). The respective pixel 82 may then begin emitting according to the provided data signal after the first global signal GLB1 is returned to a low voltage stage and the first emission clock signal ECLK1_EM subsequently returns to a low voltage state at time t6.

The EM2 signal waveform generator circuit 210 may then resume its cyclical operation at time t6, such that the emission signals for scan lines 7 and 8 returns to a low voltage state at time t7 because the emission signals for the preceding scan lines 5 and 6, the first global signal GLB1, and the second emission clock signal ECLK2_EM are in a low voltage state. To ensure that the third global signal GLB3 causes the appropriate sensing period 102 to end, the time period of the third global signal GLB3 may be less than the off period of either emission clock signal (ECLK1 or ECLK2) or approximately between 1 and 2 μs.

To reinitiate the progressive scan from at the first scan lines 1 and 2, the start pulse EVST_EM may return to a high voltage state, while the first global signal GLB1 remains low. In some embodiments, the EM2 signal waveform generator circuit 210 may pause the progressive scan of the display 26 by transitioning maintain the second global signal GLB2 at a low voltage state while keeping start pulse EVST_EM is in a high voltage state. The EM2 signal waveform generator circuit 210 may resume the progressive scan by returning the second global signal GLB2 to a high voltage state, as shown just before time t8. At time t8, when the first emission clock goes to a low voltage state, the corresponding emission signals (e.g. for scan lines 5 and 6) will transition to the high voltage state.

Figure 22:
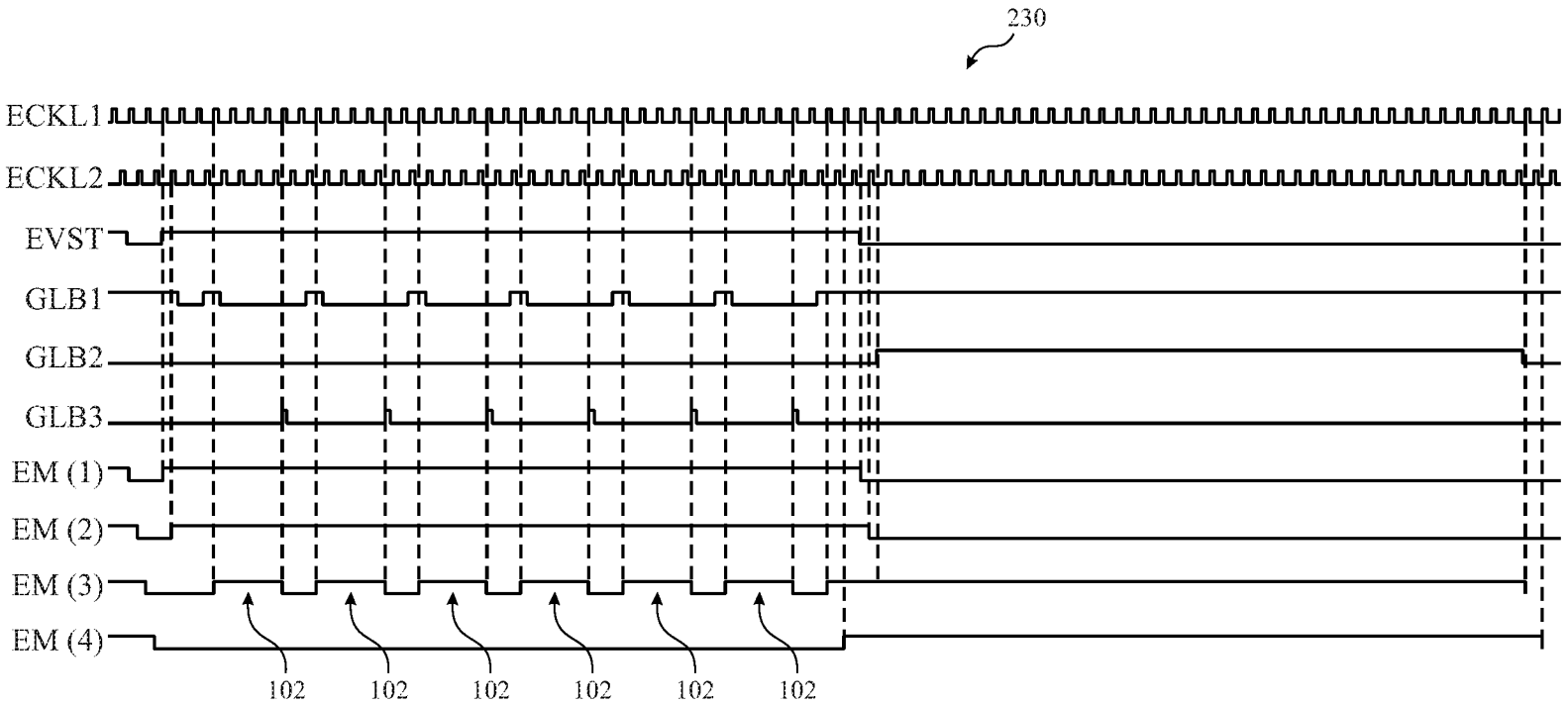
FIG. 22 illustrates a timing diagram related to emission signals provided to a number of rows of the display by the pixel driving circuit to provide multiple sensing periods for a respective pixel of the display during a progressive panel scan, in accordance with aspects of the present disclosure.

By integrating the use of the third global signal GLB3 into the EM2 signal waveform generator circuit 210, the EM2 signal waveform generator circuit 210 may enable the progressive scan of the display 26 to implement multiple sensing periods 102. By way of example, FIG. 22 illustrates how the first global signal GLB1 may be used to initiate a sensing period 102 and the third global signal GLB3 is used to end a sensing period 102 multiple times on N-type semiconductor devices. That is, like the pixel driving circuit 120 and the EM2 signal waveform generator circuit 160 described above, although the EM2 signal waveform generator circuit 210 is illustrated using P-type semiconductor devices, it should be noted that these devices may be replaced with N-type semiconductor devices when the VEL and VEH are interchanged and when the polarities of the emission clock signals (ECLK1_EM and ECLK2_EM), the global signals (GLB1, GLB2, and GLB3), and the start pulse (EVST_EM) are reversed.

With this in mind, FIG. 22 depicts a timing diagram 230 that corresponds to implementing multiple sensing periods 102 using the EM2 signal waveform generator circuit 210 equipped with N-type semiconductor devices. As such, the polarities of each signal illustrated in the collection of waveforms 230 is reversed as compared to the polarities of the signals illustrated in FIG. 21. Nevertheless, it is apparent from the collection of waveforms 230 that third global signal GLB3 may end a respective sensing period 102 multiple times by way of operation of the EM2 signal waveform generator circuit 210. As a result, sensing system 30 may sense various characteristics of the display 26 multiple times to ensure that the pixels 82 of the display perform in the same manner and provide a consistent picture. That is, by incorporating multiple sensing periods 102, the sensing system 30 may sense a threshold voltage of each pixel, a power output by each pixel, an amount of current provided to each pixel multiple times to ensure that an accurate compensation value is determined for each pixel. The processor(s) 16 may then adjust the data signals provided to each pixel based on the compensation value, as discussed above.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

What is claimed is:

1. A display device, comprising:

a plurality of rows of pixels configured to display image data on a display; and a circuit configured to:

perform a progressive scan across a plurality of rows of pixels to display the image data using a plurality of pixels of the plurality of rows of pixels, wherein the progressive scan comprises programming a subset of the plurality of pixels in each of the plurality of rows of pixels with a corresponding plurality of data voltages for one frame of the image data;

suspend the progressive scan during the one frame of the image data;

supply test data to a pixel of the plurality of pixels in a first row of the plurality of rows of pixels after the progressive scan is suspended, wherein the test data is configured to cause the pixel to output an amount of power; and resume the progressive scan across the plurality of rows of pixels to display the image data after the test data is supplied to the pixel.

2. The display device of claim 1, wherein the circuit is configured to determine one or more sensitivity properties associated with the pixel in response to receiving a pulse of a first global signal, wherein the pulse of the first global signal is configured to cause an emission turn-on signal to be provided to the pixel via the circuit.

3. The display device of claim 2, wherein the first global signal is configured to delay the emission turn-on signal from being provided to the pixel.

4. The display device of claim 2, wherein the circuit is configured to disconnect the emission turn-on signal from the pixel in response to receiving a second global signal.

5. The display device of claim 4, wherein the second global signal is between 1 and 2 μs.

6. The display device of claim 1, wherein the circuit is configured to supply a data voltage to the pixel based on the image data after the progressive scan is resumed.

7. The display device of claim 1, wherein the circuit is configured to determine one or more sensitivity properties associated with the pixel based on the power output of the pixel with respect to the test data, and wherein the one or more sensitivity properties comprise luminance values, color values, power values, or any combination thereof associated with the pixel.

8. A circuit, comprising:

a plurality of semiconductor devices configured to generate a plurality of emission turn-on signals configured to enable a pixel of a row of pixels in a display to receive a plurality of test voltages and a data voltage associated with image data during a single frame of the image data; and a processor configured to:

perform a progressive scan across a plurality of rows of pixels to display the image data using a plurality of pixels, wherein the plurality of rows of pixels comprises the pixel of the row of pixels, and wherein the progressive scan comprises programming a subset of the plurality of pixels in each of the plurality of rows of pixels with a corresponding plurality of data voltages for the single frame of the image data;

pause the progressive scan during the single frame of the image data;

supply the plurality of test voltages to the pixel after the progressive scan is paused, wherein the plurality of test voltages is configured to cause the pixel to output a plurality of amounts of power; and resume the progressive scan across the plurality of rows of pixels to display the image data after the plurality of test voltages is supplied to the pixel.

9. The circuit of claim 8, wherein the circuit is configured to determine a first set of sensitivity properties associated with the pixel based on the plurality of amount of power output by the pixel in response to receiving the plurality of test voltages.

10. The circuit of claim 9, wherein the circuit is configured to determine a compensation factor for the data voltage provided to the pixel during the single frame of image data based on the first set of sensitivity properties.

11. The circuit of claim 10, comprising a set of circuit components configured to adjust the data voltage provided to the pixel based on the compensation factor.

12. The circuit of claim 8, wherein the plurality of semiconductor devices is configured to receive a first pulse of a first global signal, wherein the first pulse of the first global signal is configured to cause the pixel to receive a first emission turn-on signal of the plurality of emission turn-on signals, wherein the first emission turn-on signal is configured to suspend the progressive scan.

13. The circuit of claim 12, wherein the plurality of semiconductor devices is configured to receive a first pulse of a second global signal, wherein the first pulse of the second global signal is configured to resume the progressive scan.

14. The circuit of claim 13, wherein the first pulse of the second global signal comprises less time than an off pulse of an emission clock signal provided to the plurality of semiconductor devices.

15. The circuit of claim 12, wherein the first emission turn-on signal is configured to start a transmission of a second emission turn-on signal in second row of pixels following the row of pixels.

16. A method, comprising:

performing, via circuitry, a progressive scan across a plurality of rows of pixels to display image data using a plurality of pixels in a display, wherein the progressive scan comprises programming a subset of the plurality of pixels in each of the plurality of rows of pixels with a respective plurality of data voltages for one frame of the image data; and supplying, via the circuitry, test data to at least one pixel of the plurality of pixels that corresponds to a first row of a plurality of rows of pixels before the progressive scan is completed during the one frame of image data, wherein the test data is configured to enable the circuitry to obtain a set of sensitivity properties associated with the at least one pixel based on a performance of the at least one pixel when the test data is provided to the at least one pixel.

17. The method of claim 16, comprising obtaining, via the circuitry, the set of sensitivity properties in response to a first pulse of a first global signal being provided to the circuitry.

18. The method of claim 17, comprising resuming, via the circuitry, the progressive scan in response to receiving a second global signal.

19. The method of claim 17, comprising delaying, via the circuitry, an emission signal provided to the first row during the progressive scan based on the first global signal.

20. The method of claim 16, comprising determining, via the circuitry, a compensation factor for data voltage provided to the at least one pixel based on the set of sensitivity properties.

* * * * *